US007317441B2

(12) United States Patent
Tobita

(10) Patent No.: US 7,317,441 B2
(45) Date of Patent: Jan. 8, 2008

(54) CONSTANT CURRENT CIRCUIT, DRIVE CIRCUIT AND IMAGE DISPLAY DEVICE

(75) Inventor: Youichi Tobita, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 187 days.

(21) Appl. No.: 10/498,047

(22) PCT Filed: Jul. 11, 2003

(86) PCT No.: PCT/JP03/08870

§ 371 (c)(1),
(2), (4) Date: Jun. 9, 2004

(87) PCT Pub. No.: WO2004/034369

PCT Pub. Date: Apr. 22, 2004

(65) Prior Publication Data

US 2005/0156917 A1 Jul. 21, 2005

(30) Foreign Application Priority Data

Oct. 9, 2002 (JP) ..... PCT/JP02/10502

(51) Int. Cl.

| | |
|---|---|
| ***G09G 3/36*** | (2006.01) |
| ***G09G 5/00*** | (2006.01) |
| ***G09G 3/10*** | (2006.01) |
| ***G06F 3/038*** | (2006.01) |
| ***G09F 1/00*** | (2006.01) |

(52) U.S. Cl. ..... 345/100; 345/206; 315/169.1; 323/282

(58) Field of Classification Search ..... 345/45, 345/46, 50, 55, 76, 80, 82, 83, 87, 92, 94, 345/95, 98, 100, 204–206, 211, 212; 315/160, 315/169.1, 169.3, 169.4; 323/282, 284, 288; 327/108, 333, 379, 538, 540, 563; 330/136, 330/254

See application file for complete search history.

(56) References Cited

U.S. PATENT DOCUMENTS 5,548,241 A * 8/1996 McClure ..... 327/538

(Continued)

FOREIGN PATENT DOCUMENTS

CN 1348167 5/2002

(Continued)

OTHER PUBLICATIONS

German Office Action issued in German Patent Application No. 103 92 172.9-32 dated Mar. 22, 2007.

(Continued)

*Primary Examiner*—Jeff Piziali
(74) *Attorney, Agent, or Firm*—McDermott Will & Emery LLP

(57) ABSTRACT

A first amplifier circuit (132) included in a voltage generating circuit (114) includes a differential circuit formed of P-type TFT elements (P101, P102) and N-type TFT elements (N101, N102), a constant current circuit (150*a*, 150*b*) and an N-type TFT element (N103). Constant current circuit (150*a*; 150*b*) includes a P-type TFT element (P132*a*; P132*b*), a capacitor (C132*a*; C132*b*), switches (S104*a*-S106*a*; S104*b*-S106*b*) and a resistance element (R132*a*; R132*b*). Capacitor (C132*a*; C132*b*) holds a voltage on a node (204; 208) in a voltage setting operation, and thus when a current is being supplied to the diode-connected P-type TFT element (P132*a*; P132*b*).

10 Claims, 22 Drawing Sheets

U.S. PATENT DOCUMENTS

| | | | | |
|---|---|---|---|---|
| 5,808,501 | A | 9/1998 | Ivanov | |
| 5,955,921 | A * | 9/1999 | Ide et al. | 330/254 |
| 5,995,073 | A | 11/1999 | Isami et al. | |
| 6,087,885 | A * | 7/2000 | Tobita | 327/379 |
| 6,091,203 | A * | 7/2000 | Kawashima et al. | 315/169.3 |
| 6,229,506 | B1 * | 5/2001 | Dawson et al. | 345/82 |
| 6,297,596 | B1 * | 10/2001 | Kajihara | 315/160 |
| 6,313,819 | B1 | 11/2001 | Maekawa et al. | |
| 6,342,782 | B1 | 1/2002 | Yamaguchi et al. | |
| 6,373,454 | B1 * | 4/2002 | Knapp et al. | 345/76 |
| 6,476,591 | B2 | 11/2002 | Yamaguchi et al. | |
| 6,650,060 | B2 * | 11/2003 | Okuda | 315/169.1 |
| 6,661,180 | B2 * | 12/2003 | Koyama | 315/169.3 |
| 6,734,836 | B2 * | 5/2004 | Nishitoba | 345/82 |
| 6,750,833 | B2 * | 6/2004 | Kasai | 345/76 |
| 6,812,768 | B2 * | 11/2004 | Kawasaki et al. | 327/333 |
| 6,812,781 | B2 * | 11/2004 | Tsuchiya | 327/563 |
| 6,891,520 | B2 * | 5/2005 | Chen et al. | 345/82 |
| 6,943,759 | B2 * | 9/2005 | Tam | 345/76 |
| 2002/0047839 | A1 | 4/2002 | Kasai | |
| 2002/0047840 | A1 | 4/2002 | Fukuda | |
| 2002/0084840 | A1 * | 7/2002 | Tsuchi | 327/563 |
| 2002/0135312 | A1 | 9/2002 | Koyama | |
| 2003/0001800 | A1 | 1/2003 | Nakajima et al. | |
| 2003/0052659 | A1 * | 3/2003 | Monomoushi et al. | 323/284 |

FOREIGN PATENT DOCUMENTS

| | | |
|---|---|---|
| EP | 0924 771 A1 | 6/1999 |
| EP | 1 223 671 A2 | 7/2002 |
| JP | 60-252924 | 12/1985 |
| JP | 62-122488 | 8/1987 |
| JP | 05-191166 | 7/1993 |
| JP | 06-214665 | 8/1994 |
| JP | 10-254412 | 9/1998 |
| JP | 11-73165 | 3/1999 |
| JP | 2001-326545 | 11/2001 |
| JP | P2002-169510 | 6/2002 |
| JP | P2002-175035 | 6/2002 |
| JP | P2002-517806 | 6/2002 |
| JP | P2003-228427 | 8/2003 |
| KR | 2001-88284 | 9/2001 |
| WO | WO 99/65011 | 12/1999 |
| WO | WO 00/41026 | 7/2000 |
| WO | WO 00/41028 | 7/2000 |

OTHER PUBLICATIONS

Chinese Office Action with English translation issued in corresponding Chinese Patent Application No. CN 038017113, dated Jul. 27, 2007.

* cited by examiner

CONSTANT CURRENT CIRCUIT, DRIVE CIRCUIT AND IMAGE DISPLAY DEVICE

TECHNICAL FIELD

The present invention relates to a constant current circuit, a drive circuit and an image display device, and particularly, to a constant current circuit, a drive circuit and an image display device, in which influences by characteristics of transistors forming circuits are removed.

BACKGROUND ART

A constant current circuit providing a flow of a constant current regardless of variations in load is one of the most basic and most important circuits in a semiconductor integrated circuit.

Conventionally, constant current circuits have been formed of circuits of a current mirror type. In the constant current circuit of the current mirror type, one of two transistors having gates connected together is diode-connected, and a constant current, which is equal to a product of a constant reference current flowing through this one transistor and a capability ratio between these transistors (more specifically, a ratio of channel widths), can flow through the other transistor connected to a load circuit kept at an independent potential.

In this constant current circuit of the current mirror type, the current setting accuracy depends on whether the transistor forming the current mirror accurately has a designed current drive capability or not. In general, a drive current Id of a transistor is expressed by the following formula (1):

$$Id=\beta(Vgs-Vth)^2 \quad (1)$$

where Vgs represents a gate voltage, Vth represents a threshold voltage, and β represents a conductance. More specifically, the setting accuracy of the drive current is affected by a conductance β determined by a manufacturing process of the transistor as well as a gate voltage, i.e., a power supply voltage, and further is affected by threshold voltage Vth of the transistor.

Japanese Patent Laying-Open No. 5-191166 has disclosed a constant current circuit for allowing setting of an intended drive current without an influence by threshold voltages Vth of transistors forming a current mirror. This constant current circuit includes a first transistor having a drain connected to a gate via a resistance R, a second transistor having a gate connected to a drain of the first transistor and having the same capability ratio as the first transistor, and a current mirror circuit, of which two transistors provide a capability ratio of K:1. Since the driving is performed by the current mirror circuit, the constant current circuit disclosed in the above reference can reduce the variations in current due to manufacturing deviation, and can set the current independently of the threshold voltages of the first and second transistors.

However, the constant current circuit disclosed in Japanese Patent Laying-Open No. 5-191166 as well as other constant current circuits using current mirrors are predicated on that two transistors forming a current mirror have the same threshold voltage Vth. For example, the constant current circuit, which is disclosed in Japanese Patent Laying-Open No. 5-191166, and includes the first and second transistors forming a current mirror, is predicated on that the first and second transistors have the same threshold voltage Vth, and that the two transistors forming the current mirror circuit driving the first and second transistors have the same threshold voltage.

Thus, the setting accuracy of the drive current lowers if two transistors forming the current mirror circuit have different threshold voltages Vth1 and Vth2, and more specifically, if threshold voltage Vth1 of a reference transistor passing a reference current therethrough is different from threshold voltage Vth2 of a drive transistor passing a drive current therethrough. Further, if threshold voltage Vth2 is larger than threshold voltage Vth1, the drive transistor may be turned off even when the reference transistor is on, in which case the drive current does not flow.

In particular, thin film transistors of a polycrystalline silicon type formed on a glass substrate or a resin substrate (which may be referred to as "TFTs" or "TFT elements" hereinafter) have threshold voltages, of which variations are larger than those of the transistors formed on silicon substrates (which may be referred to as "bulk transistors" hereinafter), and the foregoing problems remarkably appear if the constant current circuit is formed of TFTs.

In recent years, TFT liquid crystal display devices have been in the mainstream of flat-panel displays. Also, electroluminescence display devices, which are formed of TFTs of a low-temperature polycrystalline silicon type and may be referred to as "EL display devices" hereinafter, have received attention in recent few years. In these TFT liquid crystal display devices and EL display devices, it is desired to form peripheral circuits, which are formed of LSIs in conventional structures, on glass substrates together with image display portions in an integral fashion. This is because sizes of the image display device can be reduced if the image display portion and the peripheral circuit can be integrally formed on the glass substrate as described above.

In these image display devices, gradation display is performed by changing a voltage applied to pixels. Thus, the liquid crystal display devices have generally employed a voltage modulation method, in which a transmittance of liquid crystal is changed by changing voltages applied to the pixels. In the EL display devices, a display brightness of an organic light-emitting diode is changed by changing a voltage applied to the pixel, and thereby changing a current supplied to an organic light-emitting diode, i.e., a current-drive type of light-emitting element provided for each pixel.

Peripheral circuits of the image display device described above include a voltage generating circuit, which generates multiple voltages (which may be referred to as "gradation voltages" hereinafter) for driving a pixel with display brightness corresponding to image data. High operation stability is required in the voltage generating circuit providing a function of gradation display. For achieving the highly stable operation, it is important that a constant current circuit included in the voltage generating circuit performs a stable operation.

Similarly to the voltage generating circuit, high operation stability is also required in a drive circuit (analog amplifier), which receives a gradation voltage generated by the voltage generating circuit, and provides a display voltage corresponding to the received gradation voltage to data lines connected to the pixels. Further, it is required in the drive circuit to provide the precise display voltage without an offset. For the stable and precise operation of the drive circuit, it is likewise important to perform the stable operation by the constant current circuit included therein.

For reducing the sizes of the device, as described above, the voltage generating circuit and the drive circuit included in the peripheral circuits may be formed together with the image display portion on the same glass substrate in the integral fashion, and the circuits may be formed of TFTs. In this structure, however, the foregoing problem remarkably occurs in the constant current circuits formed of the TFTs, and remarkably lowers manufacturing yield of the image display devices.

DISCLOSURE OF THE INVENTION

It is an object of the invention to provide, for overcoming the above problems, a constant current circuit, which is not affected by variations in threshold voltage of transistors forming circuits.

Another object of the invention is to provide a drive circuit including a constant current circuit, which is not affected by variations in threshold voltage of transistors forming circuits.

Still another object of the invention is to provide an image display device including a constant current circuit, which is not affected by variations in threshold voltage of transistors forming circuits, and/or a drive circuit including such a constant current circuit.

According to the invention, a constant current circuit includes a transistor connected between first and second nodes; and a voltage holding circuit holding a first voltage determined depending on a threshold voltage of the transistor and provided for turning on the transistor. The transistor receives on its gate the first voltage, and passes a constant current through the first node, and the first node is connected to a differential circuit.

Also, according to the invention, an image display device includes a plurality of image display elements arranged in rows and columns; a plurality of scanning lines arranged corresponding to the rows of the plurality of image display elements, respectively, and selected successively with predetermined cycles; a plurality of data lines arranged corresponding to the columns of the plurality of image display elements, respectively; a voltage generating circuit generating at least one voltage level corresponding to display brightness of each of the plurality of image display elements; at least one buffer circuit maintaining the at least one voltage level generated by the voltage generating circuit, and amplifying current for output; and a data line driver selecting, for each of the image display elements in the row to be scanned, a voltage level indicated by pixel data corresponding to each of the image display elements in the row to be scanned from the at least one voltage level, and activating the plurality of data lines with the selected voltage level. Each of the at least one buffer circuit includes an internal circuit receiving one of the at least one voltage level, and amplifying current for output, and a constant current circuit passing a constant current through the internal circuit. The constant current circuit includes a transistor connected between the internal circuit and a first node, and a voltage holding circuit holding a first voltage determined depending on a threshold voltage of the transistor and provided for turning on the transistor. The transistor receives on its gate the first voltage, and passes the constant current through the internal circuit.

According to the invention, a drive circuit providing an output voltage in accordance with an input voltage includes a first transistor connected between a first power supply node and an output node; a constant current circuit connected between the output node and a second power supply node; and an offset compensating circuit compensating for an offset voltage occurring depending on a threshold voltage of the first transistor. The offset compensating circuit holds the offset voltage, and provides a first voltage produced by shifting the input voltage by the held offset voltage to a gate electrode of the first transistor. The constant current circuit includes a second transistor connected between the output node and the second power supply node, and a first voltage holding circuit holding a second voltage determined depending on a threshold voltage of the second transistor and provided for turning the second transistor. The second transistor receives on its gate electrode the second voltage, and passes a constant current through the first transistor connected to the output node. The first transistor receives on its gate electrode the first voltage provided from the offset compensating circuit, and provides an output voltage at the same potential as the input voltage to the output node.

According to the invention, a drive circuit providing an output voltage in accordance with an input voltage, includes a first transistor of a first conductivity type connected between a first power supply node and an output node; a first constant current circuit connected between the output node and a second power supply node; a level shift circuit receiving a first voltage, and providing a second voltage produced by shifting the received first voltage of the first conductivity type by a predetermined magnitude; and an offset compensating circuit compensating for an offset voltage occurring depending on a threshold voltage of the first transistor of the first conductivity type. The level shift circuit includes a second constant current circuit connected between a third power supply node and a gate electrode of the first transistor of the first conductivity type, and a first transistor of a second conductivity type connected between the gate electrode of the first transistor of the first conductivity type and a fourth power supply node. The offset compensating circuit holds a voltage difference between the threshold voltage of the first transistor of the first conductivity type and a threshold voltage of the first transistor of the second conductivity type, and provides, as the first voltage, a voltage produced by shifting the input voltage by the held voltage difference to a gate electrode of the first transistor of the second conductivity type. The first constant current circuit includes a second transistor of the first conductivity type connected between the output node and the second power supply node, and a first voltage holding circuit holding a third voltage determined depending on a threshold voltage of the second transistor of the first conductivity type and provided for turning on the second transistor of the first conductivity type. The second transistor of the first conductivity type receives on its gate electrode the third voltage, and passes a constant current through the first transistor of the first conductivity type connected to the output node. The second constant current circuit includes a second transistor of the second conductivity type connected between the third power supply node and the gate electrode of the first transistor of the first conductivity type, and a second voltage holding circuit holding a fourth voltage determined depending on a threshold voltage of the second transistor of the second conductivity type and provided for turning on the second transistor of the second conductivity type. The second transistor of the second conductivity type receives on its gate electrode the fourth voltage, and passes a constant current through the first transistor of the second conductivity type connected to the gate electrode of the first transistor of the first conductivity type. The first transistor of the second conductivity type receives on its gate electrode the first voltage provided from the offset compensating circuit, and provides the second voltage produced by shifting the first voltage by the threshold voltage of the first transistor of the second conductivity type to the gate electrode of the first transistor of the first conductivity type. The first transistor of the first conductivity type receives on its gate electrode the second voltage provided from the level shift circuit, and provides an output voltage at the same potential as the input voltage to the output node.

According to the invention, an image display device includes a plurality of image display elements arranged in rows and columns; a plurality of scanning lines arranged corresponding to the rows of the plurality of image display elements, respectively, and selected successively with predetermined cycles; a plurality of data lines arranged corresponding to the columns of the plurality of image display elements, respectively; a voltage generating circuit generating at least one voltage corresponding to display brightness in each of the plurality of image display elements; a decode circuit selecting, for the image display elements in the row to be scanned, a voltage designated by the pixel data corresponding to each of the image display elements in the row to be scanned from the at least one voltage; and the foregoing drive circuit receiving the voltage selected by the decode circuit from the decode circuit, and activating the plurality of data lines with the corresponding voltage.

The above constant current circuit according to the invention includes a voltage holding circuit holding a voltage set in accordance with the threshold voltage of the drive transistor passing the current, and the drive transistor receives on its gate the voltage held by the voltage holding circuit and passes the current therethrough.

According to the invention, therefore, even when variations due to manufacturing occur in threshold voltage of the drive transistor, influences by such variations are removed, and the constant current circuit can perform a stable operation.

Owing to the stability in operation of the constant current circuit, the drive circuit and the image display device provided with the constant current circuit can achieve the stable operations.

BEST MODES FOR CARRYING OUT THE INVENTION

Embodiments of the invention will now be described in detail with reference to the drawings. The same or corresponding portions bear the same reference numbers, and description thereof is not repeated.

First Embodiment

Figure 1:
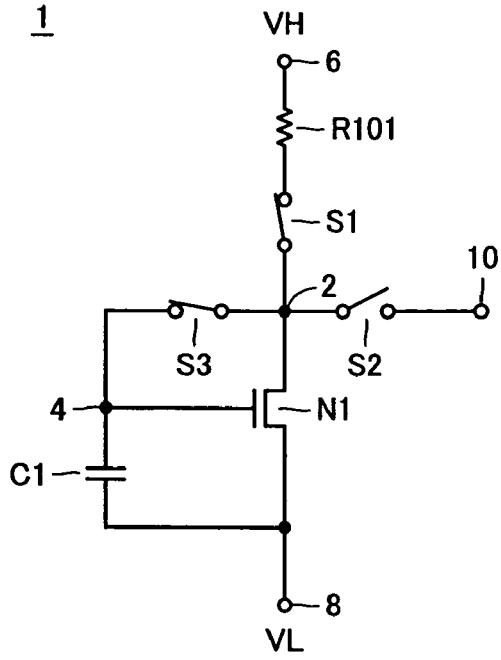
FIG. 1 is a circuit diagram showing a configuration of a constant current circuit according to a first embodiment of the invention.

FIG. 1 is a circuit diagram showing a configuration of a constant current circuit according to a first embodiment of the invention.

Referring to FIG. 1, a constant current circuit 1 includes an N-type transistor N1, a capacitor C1, switches S1-S3 and a resistance element R101. N-type transistor N1 is a drive transistor passing a constant current therethrough, is connected between a node 2 and a node 8 applied with a constant voltage VL, and having a gate connected to a node 4. N-type transistor N1 may be either an N-type TFT or an N-type bulk transistor. Capacitor C1 is provided for holding a gate voltage of N-type transistor N1, and is connected between nodes 4 and 8.

Switches S1-S3 change their states in accordance with a voltage setting operation for setting a gate voltage of N-type transistor N1 and a current drive operation. Switch S1 is connected between resistance element R101 and node 2. Switch S2 is connected between node 2 and a node 10, which is connected to a load requiring a constant current, and switch S3 is connected between nodes 2 and 4. Resistance element R101 is provided for supplying a predetermined current to node 2 when setting a voltage, and is connected between switch S1 and a node 6, which is applied with a predetermined voltage VH higher than voltage VL.

Figure 2:
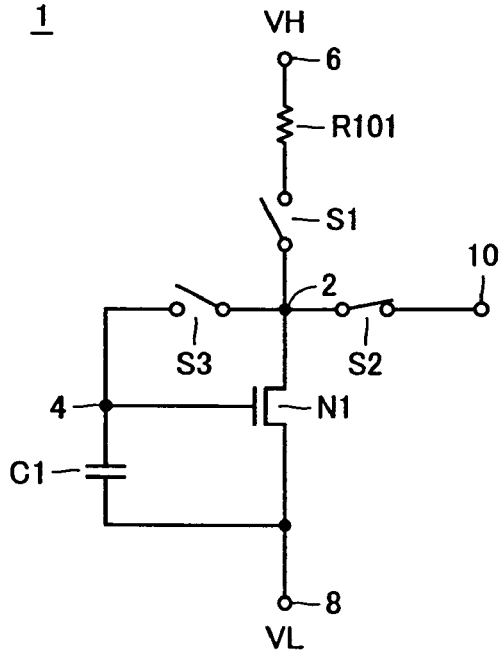
FIG. 2 shows an operation state during current driving of the constant current circuit shown in FIG. 1.

Constant current circuit 1 can operate in two operation modes, i.e., a voltage setting operation mode for setting the gate voltage of N-type transistor N1 and a current drive operation mode for an original function. FIG. 1 shows an operation state for voltage setting, and FIG. 2 shows an operation state for current driving, which will be described later. The voltage setting operation in constant current circuit 1 will now be described.

For the voltage setting operation, switches S1 and S3 are turned on, and switch S2 is turned off. Thereby, a current flows from node 6 to node 8 through resistance element R101, switch S1 and diode-connected N-type transistor N1, and the voltage on node 4 attains a voltage level of (Vth1+ΔV1) higher than threshold voltage Vth1 of N-type transistor N1. Capacitor C1 is charged with electric charges corresponding to the voltage level of node 4.

Although not shown, when charging of capacitor C1 is completed, switches S1 and S3 are turned off, and capacitor C1 holds node 4 at the voltage level of (Vth1+ΔV1).

FIG. 2 shows an operation state during current driving of constant current circuit 1.

Referring to FIG. 2, when capacitor C1 is charged with electric charges corresponding to the voltage level of (Vth1+ΔV1) and switches S1 and S3 are turned off, switch S2 is turned on. Thereby, a current flows from node 10 to node 8 through switch S2 and N-type transistor N1.

Since capacitor C1 holds the voltage on node 4, i.e., the gate voltage of N-type transistor N1 at the constant voltage level of (Vth1+ΔV1) higher than threshold voltage Vth1, N-type transistor N1 can pass the constant current.

A value of current flowing through N-type transistor N1 depends on a value of ΔV1, which can be controlled by a resistance value of resistance element R101.

In FIGS. 1 and 2, capacitor C1 is connected to node 8. However, it may be connected to another node applied with a constant voltage.

Constant current circuit 1 according to the first embodiment can be applied to a general-purpose operational amplifier if it is used in a manner, which can ensure time periods for switching switches S1-S3. The operational amplifier can be applied in various manners. For example, if an operational amplifier is used in a sample hold circuit, time periods for switching switches S1-S3 can be ensured before sampling signals. Therefore, constant current circuit 1 can be applied to such an operational amplifier.

As described above, constant current circuit 1 of the first embodiment holds the gate voltage, which appears when the drive transistor, i.e., N-type transistor N1 is passing a constant current therethrough, and drives N-type transistor N1 based on the voltage thus held. Therefore, the constant current can stably flow even if large variations occur in threshold voltage of N-type transistor N1.

Second Embodiment

Figure 3:
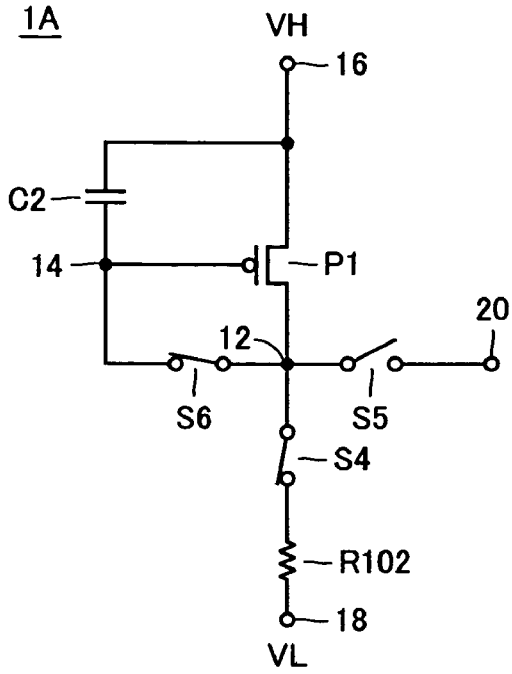
FIG. 3 is a circuit diagram showing a configuration of a constant current circuit according to a second embodiment of the invention.

FIG. 3 is a circuit diagram showing a configuration of a constant current circuit according to a second embodiment of the invention.

Referring to FIG. 3, a constant current circuit 1A includes a P-type transistor P1, a capacitor C2, switches S4-S6 and a resistance element R02. P-type transistor P1 is a drive transistor passing a constant current, is connected between a node 16 applied with a constant voltage VH and a node 12, and has a gate connected to a node 14. P-type transistor P1 may be either a P-type TFT or a P-type bulk transistor. Capacitor C2 is provided for holding a gate voltage of P-type transistor P1, and is connected between nodes 16 and 14.

Switches S4-S6 change their states in accordance with a state for setting the gate voltage of P-type transistor P1 and a state for current driving. Switch S4 is connected between node 12 and resistance element R101, and switch S5 is connected between node 12 and a node 20, which is connected to a load requiring a constant current. Switch S6 is connected between nodes 12 and 14. Resistance element R102 is provided for passing a predetermined current through node 12 in the voltage setting operation, and is connected between switch S4 and a node 18, which is applied with predetermined voltage VL lower than voltage VH.

Figure 4:
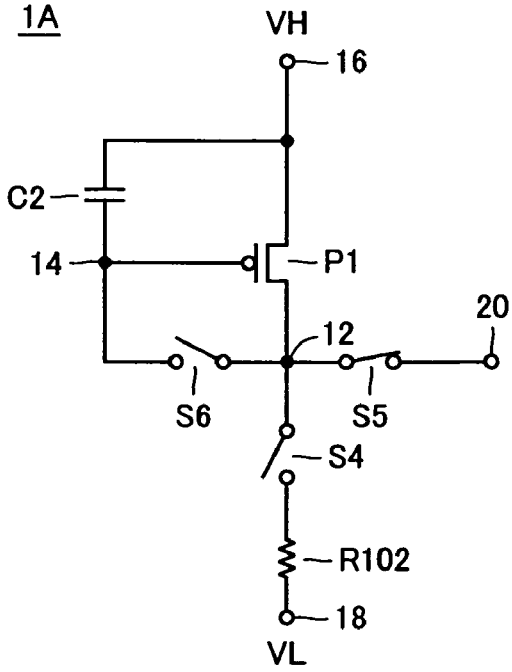
FIG. 4 shows an operation state during current driving of the constant current circuit shown in FIG. 3.

This constant current circuit 1A has a configuration corresponding to that of constant current circuit 1 of the first embodiment except for that polarities are inverted. FIG. 3 shows an operation state of the voltage setting operation, and FIG. 4 shows an operation state for the current driving operation, which will be described later. A voltage setting operation of constant current circuit 1A will now be described.

For setting the voltage, switches S4 and S6 are turned on, and switch S5 is turned off. Thereby, a current flows from node 16 to node 18 through diode-connected P-type transistor P1, switch S4 and resistance element R102, and node 14 attains a voltage level of (VH−|Vth2|−ΔV2) based on a threshold voltage Vth2 of P-type transistor P1. Capacitor C2 is charged with electric charges corresponding to the voltage level of node 14.

Although not shown, when charging of capacitor C2 is completed, switches S4 and S6 are turned off, and capacitor C2 holds the voltage on node 14 at the level of (VH−|Vth2|−ΔV2).

FIG. 4 shows the operation state during the current driving of constant current circuit 1A.

Referring to FIG. 4, when capacitor C2 is charged with electric charges corresponding to the voltage level of (VH−|Vth2|−ΔV2) and switches S4 and S6 are turned off, switch S5 is turned on. Thereby, a current flows from node 16 to node 20 through P-type transistor P1 and switch S5.

In this state, capacitor C2 holds the voltage on node 14, i.e., the gate voltage of P-type transistor P1 at the constant level of (VH−|Vth2|−ΔV2) so that P-type transistor P1 can pass a constant current.

A value of current flowing through P-type transistor P1 depends on AV2, which can be controlled by the resistance value of resistance element R102.

In FIGS. 3 and 4, capacitor C2 is connected to node 16. However, it may be connected to another node applied with a constant voltage.

Similarly to constant current circuit 1 of the first embodiment, constant current circuit 1A according to the second embodiment can be applied to a general-purpose operational amplifier if it is used in a manner, which can ensure time periods for switching switches S4-S6.

As described above, constant current circuit 1A of the second embodiment can achieve an effect similar to that by constant current circuit 1 of the first embodiment.

Third Embodiment

In a third embodiment, constant current circuit 1 of the first embodiment is applied to a differential amplifier.

Figure 5:
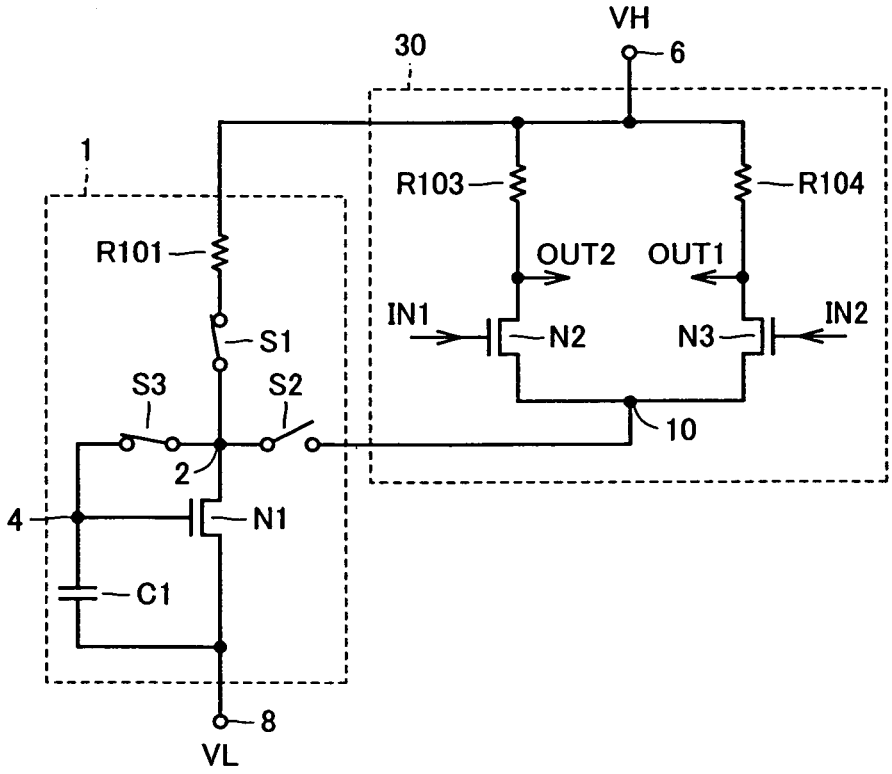
FIG. 5 is a circuit diagram showing a configuration of a differential amplifier according to a third embodiment of the invention.

FIG. 5 is a circuit diagram showing a configuration of a differential amplifier according to the third embodiment.

Referring to FIG. 5, the differential amplifier according to the third embodiment includes constant current circuit 1 and a differential circuit 30. N-type transistor N1 of constant current circuit 1 is formed of an N-type TFT. The configuration of constant current circuit 1 is already described, and therefore, description thereof is not repeated.

Differential circuit 30 includes N-type TFT elements N2 and N3 as well as resistance elements R103 and R104. N-type TFT element N2 is connected between resistance element R103 and node 10, and receives on its gate an input signal IN1. N-type TFT element N3 is connected between resistance element R104 and node 10, and receives on its gate an input signal IN2. Resistance element R103 is connected between node 6 and N-type TFT element N2, and resistance element R104 is connected between node 6 and N-type TFT element N3.

In the differential amplifier according to the third embodiment, transistors forming the circuits are TFTs, and are arranged on a glass substrate or a resin substrate.

FIG. 5 shows a state of the operation of setting a voltage in constant current circuit 1. In the voltage setting operation, switch S2 is off so that differential circuit 30 is electrically isolated from constant current circuit 1, and is inactive. The operation of setting the voltage in constant current circuit 1 is already described in connection with the first embodiment, and therefore, description thereof is not repeated.

Figure 6:
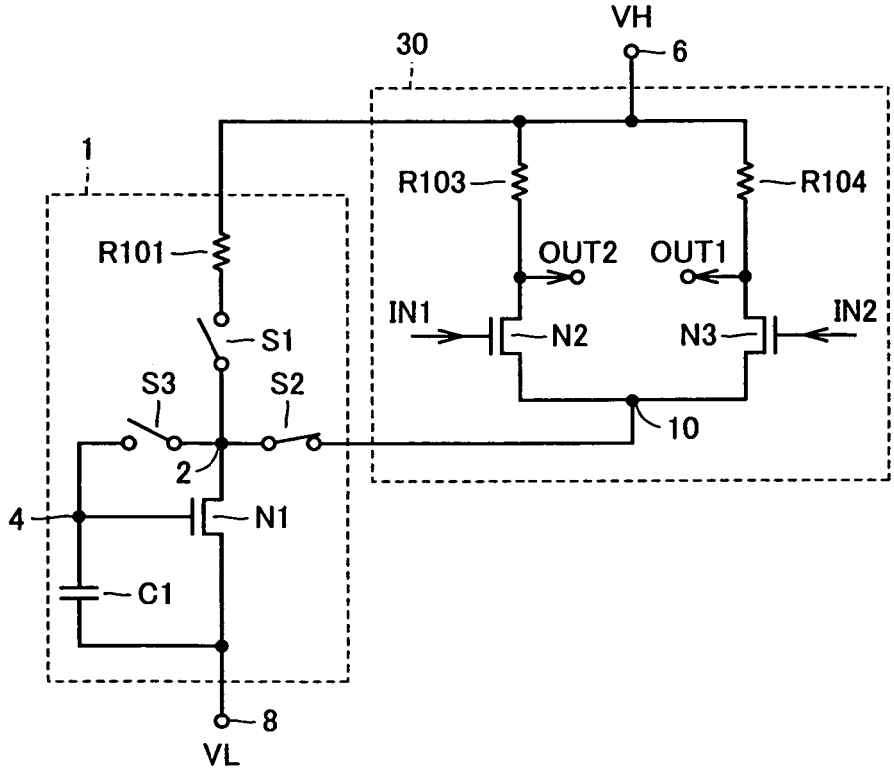
FIG. 6 shows an operation state during an active state of the differential amplifier according to the third embodiment of the invention.

FIG. 6 shows an operation state during the active state of the differential amplifier according to the third embodiment.

In the active state shown in FIG. 6, switches S1 and S3 are off, and switch S2 is on so that differential circuit 30 is active. Although the differential amplifier of this embodiment is formed of TFTs, it employs constant current circuit 1 as a constant current supply so that the differential amplifier can operate stably. If a conventional differential amplifier of a current mirror type were formed of TFTs, a constant current circuit would not operate due to variations in threshold voltage of the TFTs, and the differential amplifier would malfunction. However, such a malfunction does not occur in the differential amplifier according to the third embodiment.

In the differential amplifier according to the third embodiment, electric charges held in capacitor C1 will be lost due to a gate leak current of N-type TFT element N1, a leak current of capacitor C1 itself or a leak current of switch S3. Therefore, a refresh operation, i.e., the voltage setting operation described above is executed at predetermined intervals.

According to the differential amplifier of the third embodiment, as described above, the constant current circuit activating the differential amplifier is formed of constant current circuit 1 of the first embodiment. Therefore, the operation can be stable although the differential amplifier is formed of the TFTs.

Modification of Third Embodiment

Figure 7:
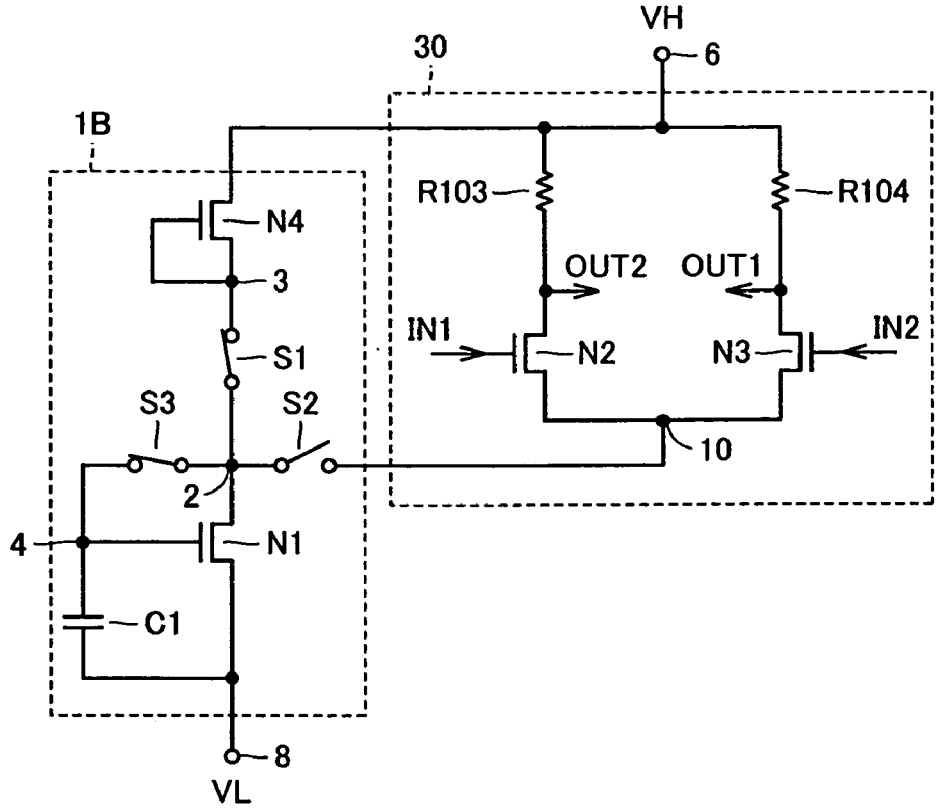
FIG. 7 is a circuit diagram showing a modification of a differential amplifier shown in FIG. 5.

FIG. 7 is a circuit diagram showing a modification of the differential amplifier shown in FIG. 5.

A configuration of the differential amplifier shown in FIG. 7 corresponds to that of the differential amplifier shown in FIG. 5, but includes a constant current circuit 1B instead of constant current circuit 1. Constant current circuit 1B includes an N-type TFT element N4 instead of resistance element R101 in constant current circuit 1. Configurations other than the above are the same as those of the differential amplifier shown in FIG. 5.

N-type TFT element N4 forms a transistor of a depression type having a source connected to a gate. In general, a current Id flowing through the depression-type transistor is expressed by the following formula (2) because a gate voltage Vgs with respect to a source is 0 V.

$$Id=\beta(-Vth)^2 \quad (2)$$

where Vth represents a threshold voltage, and β represents a conductance. Thus, current Id flowing through N-type TFT element N4 does not depend on voltages VH and VL, and is constant.

In the voltage setting operation, which must be performed at predetermined intervals, even when voltages VH and VL change, N-type TFT element N4, which can supply a constant current, sets node 4 to a constant voltage level every time, and constant current circuit 1B supplies a constant current to node 10 without variations, which may occur in current value depending on the voltage setting operations. Therefore, the operation of the differential amplifier becomes further stable.

As described above, the differential amplifier employs N-type TFT element N4 of the depression type, which can supply a constant current, as the current supply circuit for the voltage setting operation in the constant current circuit. Therefore, the set voltage in constant current circuit 1B is constant in each voltage setting operation so that the operation of the differential amplifier becomes further stable.

Fourth Embodiment

In a fourth embodiment, constant current circuit 1A of the second embodiment is applied to a differential amplifier.

Figure 8:
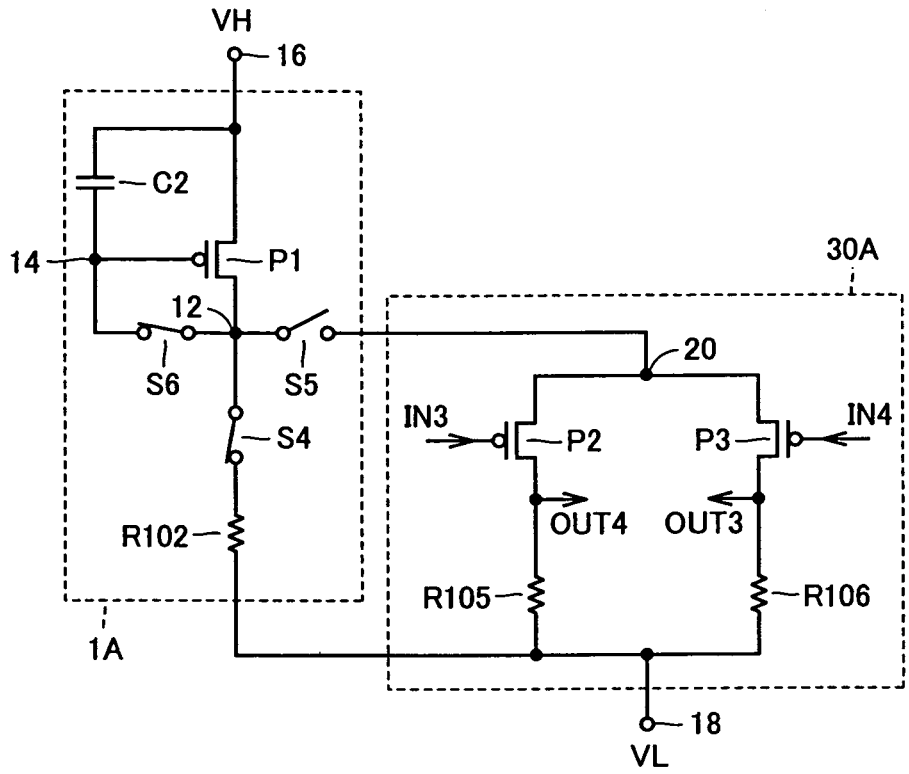
FIG. 8 is a circuit diagram showing a configuration of a differential amplifier according to a fourth embodiment of the invention.

FIG. 8 is a circuit diagram showing a configuration of a differential amplifier according to the fourth embodiment.

Referring to FIG. 8, the differential amplifier according to the fourth embodiment includes constant current circuit 1A and a differential circuit 30A. P-type transistor P1 of constant current circuit 1A is formed of a P-type TFT. The configuration of constant current circuit 1A is already described, and therefore, description thereof is not repeated.

Differential circuit 30A includes P-type TFT elements P2 and P3, and resistance elements R105 and R106. P-type TFT element P2 is connected between node 20 and resistance element R105, and receives on its gate an input signal IN3. P-type TFT element P3 is connected between node 20 and resistance element R106, and receives on its gate an input signal IN4. Resistance element R105 is connected between P-type TFT element P2 and node 18, and resistance element R106 is connected between P-type TFT element P3 and node 18.

In the differential amplifier according to the fourth embodiment, transistors forming the circuits are TFTs, and are arranged on a glass substrate or a resin substrate.

FIG. 8 shows a state of the operation of setting a voltage in constant current circuit 1A. In the voltage setting operation, switch S5 is off so that differential circuit 30A is electrically isolated from constant current circuit 1A, and is inactive. The operation of setting the voltage in constant current circuit 1A is already described in connection with the second embodiment, and therefore, description thereof is not repeated.

Figure 9:
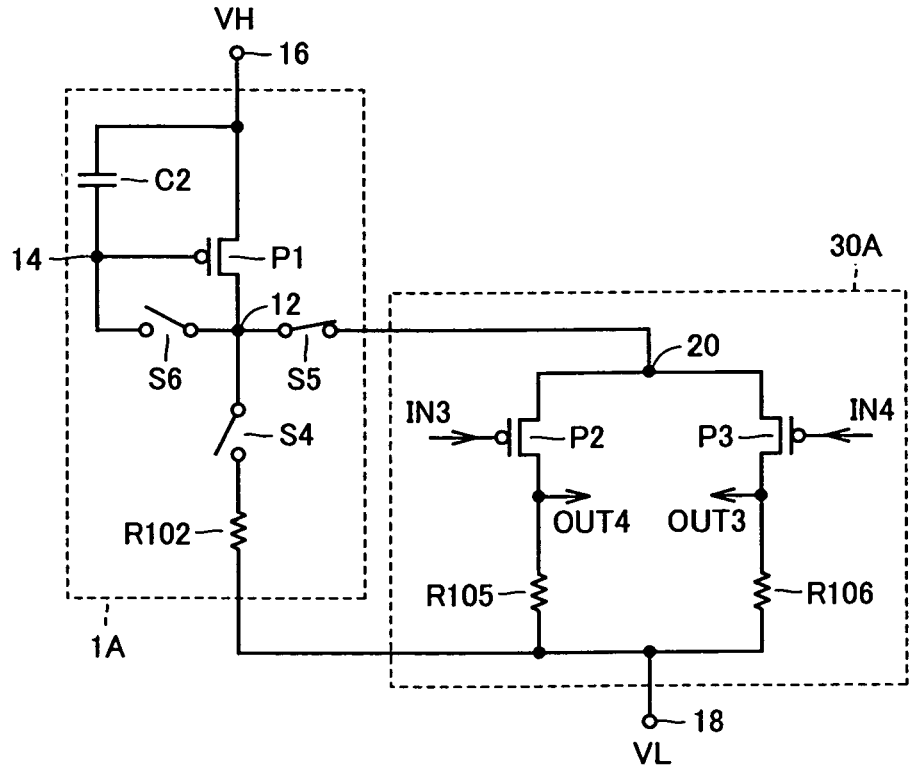
FIG. 9 shows an operation state during an active state of the differential amplifier according to the fourth embodiment of the invention.

FIG. 9 shows an operation state during the active state of the differential amplifier according to the fourth embodiment.

In the active state shown in FIG. 9, switches S4 and S6 are off, and switch S5 is on so that differential circuit 30A is active. Although the differential amplifier of this embodiment is likewise formed of TFTs, it employs constant current circuit 1A as a constant current supply so that the differential amplifier can operate stably.

In the differential amplifier according to the fourth embodiment, electric charges held in capacitor C2 will be lost due to a gate leak current of P-type TFT element P1, a leak current of capacitor C2 itself or a leak current of switch S6. Therefore, the refresh operation, i.e., the voltage setting operation described above is executed at predetermined intervals.

In the foregoing description, the differential amplifier is formed of the TFTs. However, it may be formed of bulk transistors.

According to the differential amplifier of the fourth embodiment, as described above, the constant current circuit activating the differential amplifier is formed of constant current circuit 1A of the second embodiment. Therefore, the operation can be stable even in the differential amplifier formed of the TFTs.

Modification of Fourth Embodiment

Figure 10:
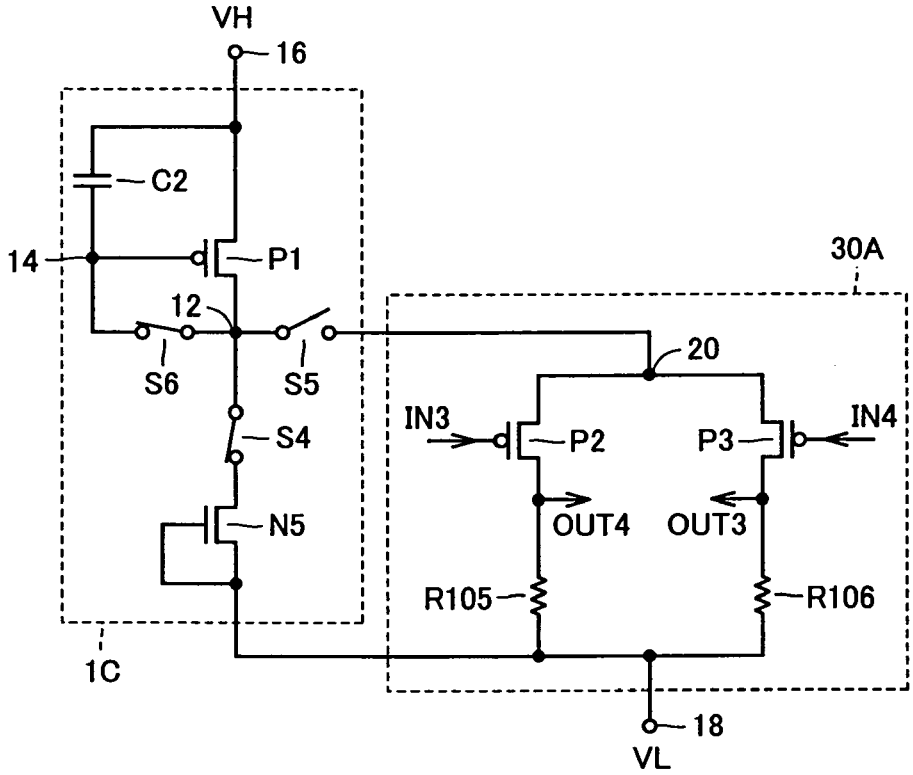
FIG. 10 is a circuit diagram showing a modification of the differential amplifier shown in FIG. 8.

FIG. 10 is a circuit diagram showing a modification of the differential amplifier shown in FIG. 8.

Referring to FIG. 10, the differential amplifier has a configuration corresponding to that of the differential amplifier shown in FIG. 8, but includes a constant current circuit 1C instead of constant current circuit 1A. Constant current circuit 1C corresponds to constant current circuit 1A, but includes an N-type TFT element N5 instead of resistance element R102. Configurations other than the above are the same as those of the differential amplifier shown in FIG. 8.

N-type TFT element N5 forms a transistor of a depression type having a source connected to a gate. Therefore, current Id flowing through N-type TFT element N5 does not depend on voltages VH and VL, and is constant, as is already described in connection with the modification of the third embodiment.

In the voltage setting operation, which must be performed at predetermined intervals, even when voltages VH and VL change, N-type TFT element N5, which can supply a constant current, sets node 14 to a constant voltage level every time, and constant current circuit 1C supplies a constant current through node 20 without variations, which may occur in current value depending on the voltage setting operations. Therefore, the operation of the differential amplifier becomes further stable.

The differential amplifier described above can achieve the effect similar to that of the modification of the third embodiment.

Fifth Embodiment

In a fifth embodiment, the constant current circuits of the first and second embodiments are applied to liquid crystal display devices.

Figure 11:
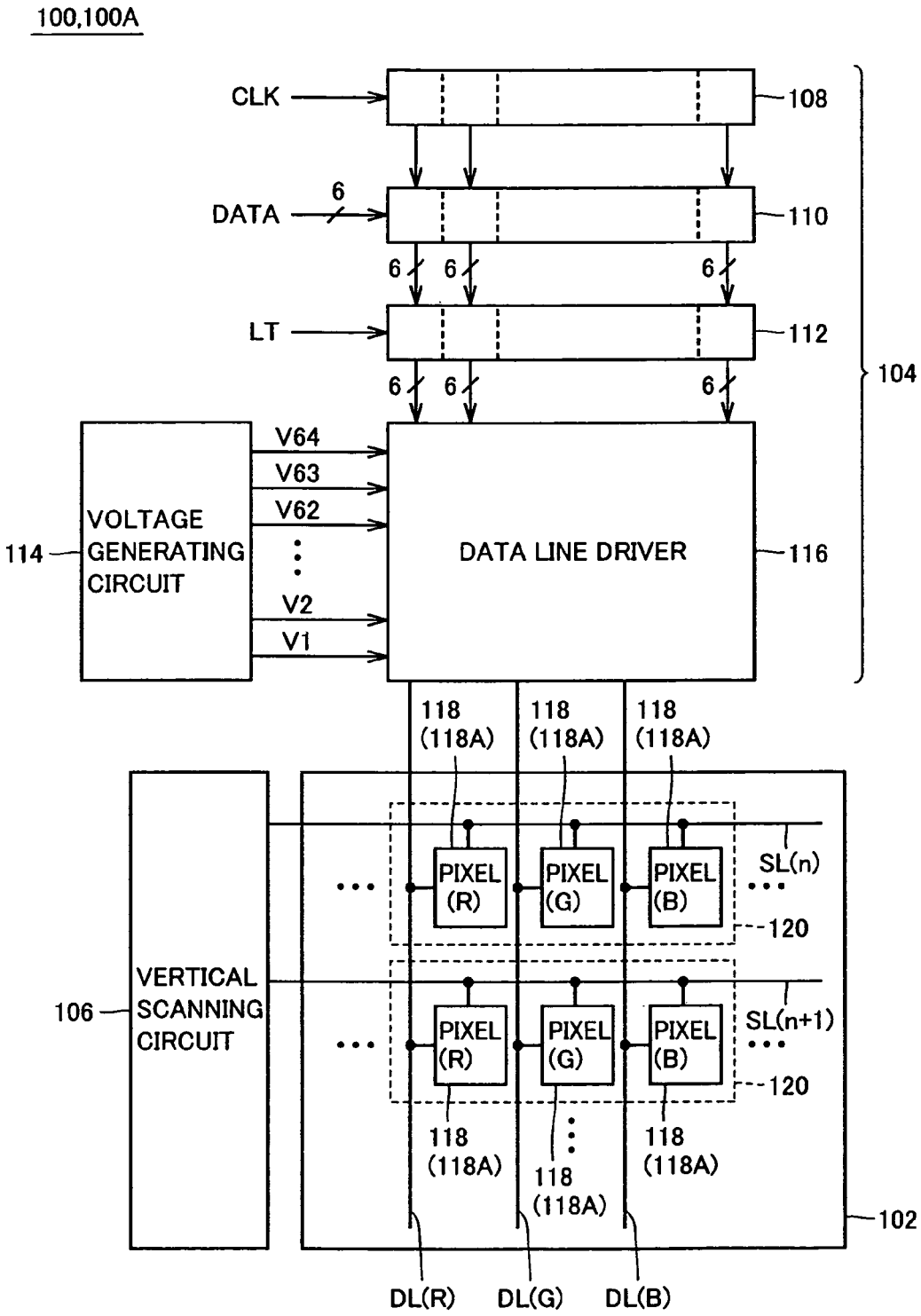
FIG. 11 is a schematic block diagram showing a whole configuration of a color liquid crystal display device according to a fifth embodiment of the invention.

FIG. 11 is a schematic block diagram showing a whole configuration of a color liquid crystal display device according to the fifth embodiment of the invention.

Referring to FIG. 11, a color liquid crystal display device 100 includes a display portion 102, a horizontal scanning circuit 104 and a vertical scanning circuit 106.

Display portion 102 includes a plurality of pixels 118 arranged in rows and columns. Each pixel 118 is provided with a color filter of one of three primary colors, i.e., R (Red), G (Green) and B (Blue). Three pixels (R), (G) and (B) neighboring to each other in the column direction form one display unit 120. A plurality of scanning lines SL are arranged corresponding to the rows (which may be referred to as "lines" hereinafter) of pixels 118, respectively, and a plurality of data lines DL are arranged corresponding to the columns of pixels 118, respectively.

Horizontal scanning circuit 104 includes a shift register 108, first and second data latch circuits 110 and 112, a voltage generating circuit 114 and a data line driver 116.

Shift register 108 receives a clock signal CLK, and successively provides a pulse signal to a data latch circuit 110 in synchronization with clock signal CLK.

First data latch circuit 110 receives pixel data DATA of six bits for selecting one voltage from drive voltages at 64 levels generated from voltage generating circuit 114, which will be described later, and internally latches pixel data DATA in synchronization with the pulse signal received from shift register 108.

When first data latch circuit 110 takes in pixel data DATA for one line, second data latch circuit 112 receives a latch signal LT, takes in pixel data DATA for one line latched by first data latch circuit 110, and latches the same.

Voltage generating circuit 114 generates drive voltages V1-V64 at 64 levels for performing gradation display with 64-level by each pixel 118.

Data line driver 116 receives the pixel data for one line provided from second data latch circuit 112 as well as drive voltages V1-V64 provided from voltage generating circuit 114, selects the drive voltages for the respective pixels in accordance with the pixel data, and provides them to data lines DL neighboring to each other in the column direction at the same time.

Vertical scanning circuit 106 successively activates scanning lines SL neighboring to each other in the row direction in accordance with predetermined timing.

In liquid crystal display device 100, first data latch circuit 110 successively takes in pixel data DATA in accordance with the pulse signal provided from shift register 108 in synchronization with clock signal CLK. In response to latch signal LT received in accordance with taking of pixel data DATA for one line, second data latch circuit 112 takes in and latches pixel data DATA for one line, which was taken into first data latch circuit 110, from first data latch circuit 110, and provides the pixel data DATA for one line to data line driver 116.

Based on the pixel data for one line received from second data latch circuit 112, data line driver 116 selects the drive voltage for each pixel from drive voltages V1-V64 at 64 levels received from voltage generating circuit 114, and provides the drive voltages corresponding to the pixels for one line to data lines DL at the same time. When vertical scanning circuit 106 activates scanning line SL corresponding to the scan target row, i.e., row to be scanned, all pixels 118 connected to the scanning line SL thus activated simultaneously become active, and each perform display with brightness corresponding to the drive voltage applied to corresponding data line DL so that the pixel data for one line is displayed.

The above operations are successively conducted for the respective scanning lines neighboring in the row direction so that display portion 102 displays images.

Figure 12:
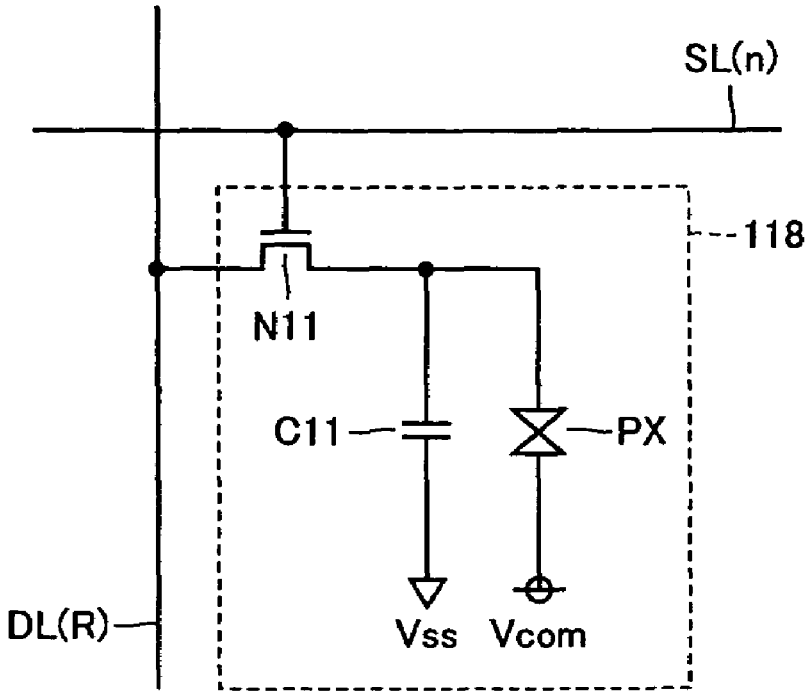
FIG. 12 is a circuit diagram showing a configuration of a pixel shown in FIG. 11.

FIG. 12 is a circuit diagram showing a configuration of pixel 118 shown in FIG. 11. Although FIG. 12 shows pixel 118 connected to data line DL(R) and scan line SL(n), other pixels have substantially the same configurations.

Referring to FIG. 12, pixel 118 is formed of an N-type TFT element N11, a liquid crystal display element PX and a capacitor C11.

N-type TFT element N11 is connected between data line DL(R) and liquid crystal display element PX, and has a gate connected to scanning line SL(n). Liquid crystal display element PX has a pixel electrode connected to N-type TFT element N11 and a counter electrode bearing a counter electrode potential Vcom. Capacitor C11 has one side connected to the pixel electrode and the other side fixed at a common potential Vss.

In liquid crystal display element PX, orientation of liquid crystal changes in accordance with a potential difference between the pixel electrode and the counter electrode so that the brightness (reflectance) of liquid crystal display element PX changes. Thereby, liquid crystal display element PX can perform the display with the brightness (reflectance) corresponding to the drive voltage applied from data line DL(R) via N-type TFT element N11.

After scanning line SL(n) is activated and data line DL(R) applies the drive voltages to liquid crystal display elements PX, scanning line SL(n) is deactivated, and N-type TFT element N11 is turned off for starting the image display by next scanning line SL(n+1). Even during the off state of N-type TFT element N11, however, capacitor C11 holds the potential of the pixel electrode so that the liquid crystal display element PX can maintain the brightness (reflectance) corresponding to the pixel data.

Figure 13:
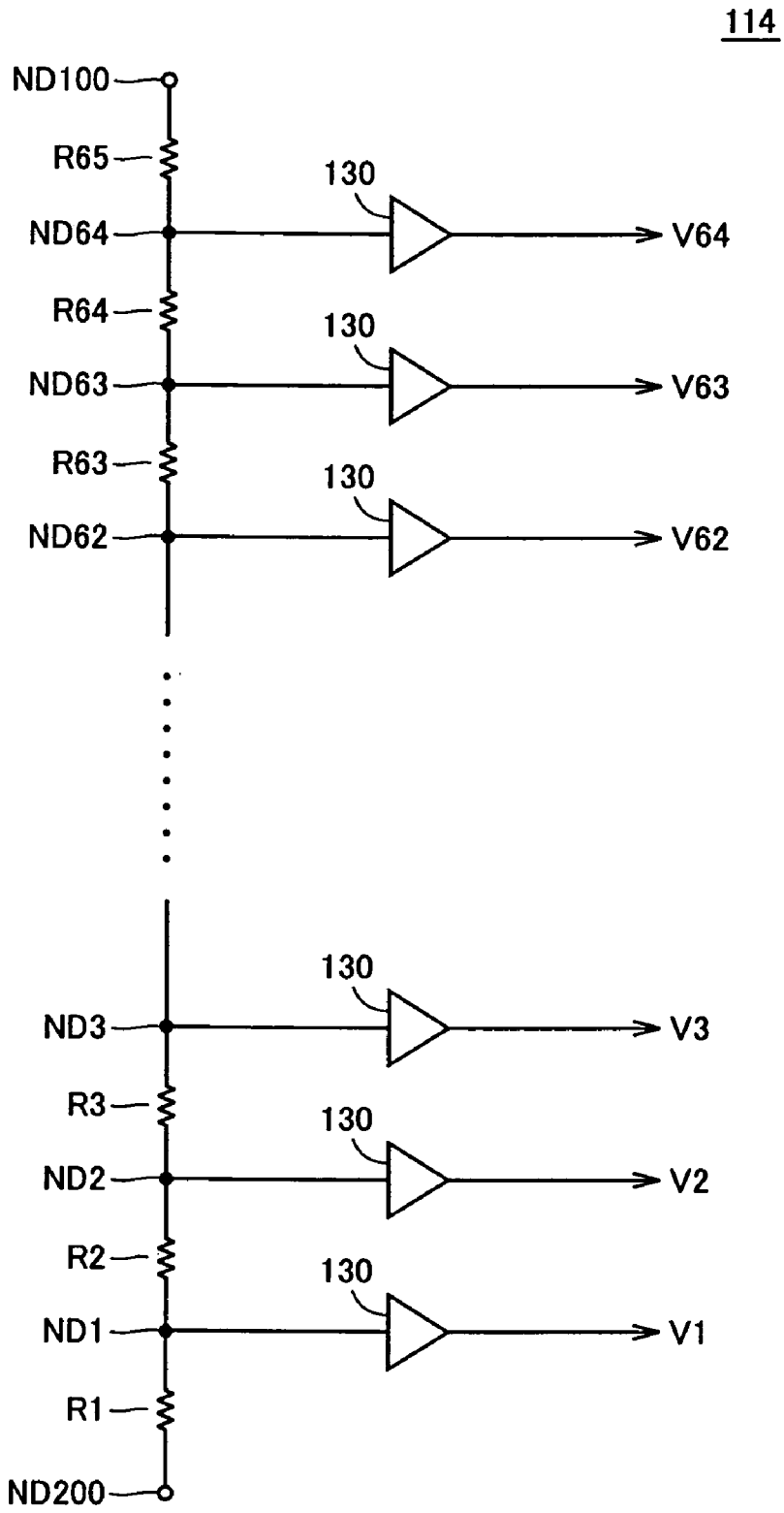
FIG. 13 is a circuit diagram showing a configuration of a voltage generating circuit shown in FIG. 11.

FIG. 13 is a circuit diagram showing a configuration of voltage generating circuit 114 shown in FIG. 11.

Referring to FIG. 13, voltage generating circuit 114 includes nodes ND100 and ND200, resistance elements R1-R65 and nodes ND1-ND64, and also includes sixty-four buffer circuits 130, which are provided corresponding to nodes ND1-ND64, and are internally provided with constant current circuits, respectively.

Resistance elements R1-R65 are connected in series between nodes ND100 and ND200 via nodes NDN1-ND64 to a form a ladder resistance circuit. This ladder resistance circuit divides the voltage across nodes ND100 and ND200 to generate drive voltages V1-V64 at 64 levels on nodes ND1-ND64, respectively. Each buffer circuit 130 has a drive power enough to drive data line DL and the pixel, is connected to a corresponding node among nodes ND1-ND64 and provides a voltage at the same level as the input voltage.

Liquid crystal display element PX requires AC driving so that the voltages applied to node ND100 and ND200 alternately change at cycles corresponding to one line or one frame.

Figure 14:
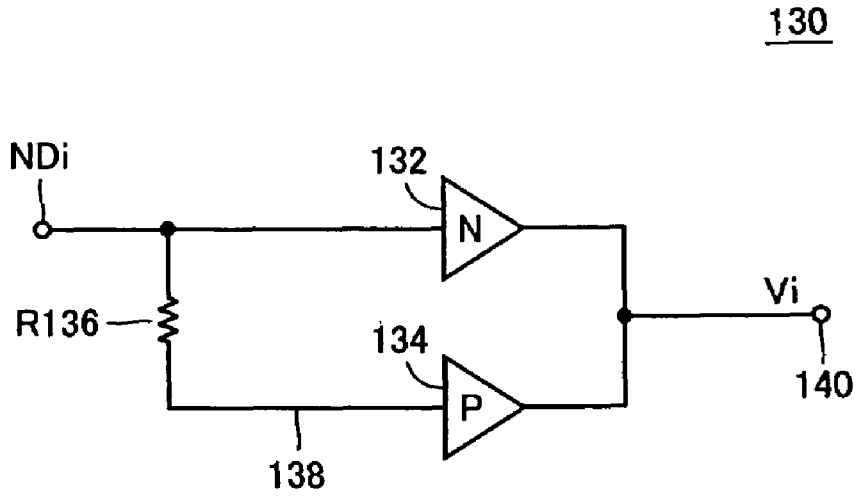
FIG. 14 is a circuit diagram showing a configuration of a buffer circuit shown in FIG. 13.

FIG. 14 is a circuit diagram showing a configuration of buffer circuit 130 shown in FIG. 13.

Referring to FIG. 14, buffer circuit 130 is formed of first and second amplifier circuits 132 and 134 each internally having a constant current circuit, a resistance element R136 and a node 138. First amplifier circuit 132 is connected between a node NDi and an output node 140, and second amplifier circuit 134 is connected between node 138 and output node 140. Resistance element R136 is connected between node NDi and node 138.

First and second amplifier circuits 132 and 134 form an amplifier of a push-pull type. More specifically, first amplifier circuit 132 charges output node 140 with a small current drive power, and discharges output node 140 with a sufficient current drive power when the voltage level of output node 140 exceeds the voltage level of node NDi. Second amplifier circuit 134 charges output node 140 with a sufficient current drive power when the voltage level of output node 140 lowers the voltage level of node 138.

If first and second amplifier circuits 132 and 134 operated simultaneously, a large current would flow from second amplifier circuit 134 to first amplifier circuit 132. Therefore, resistance element R136 is provided for providing a potential difference between input potentials of first and second amplifier circuits 132 and 134, and thereby preventing simultaneous operation of first and second amplifier circuits 132 and 134. Resistance element R136 has a sufficiently small value within a range, which can prevent the simultaneous operation of first and second amplifier circuits 132 and 134, so that large variations may not occur in drive voltage provided to output node 140.

Figure 15:
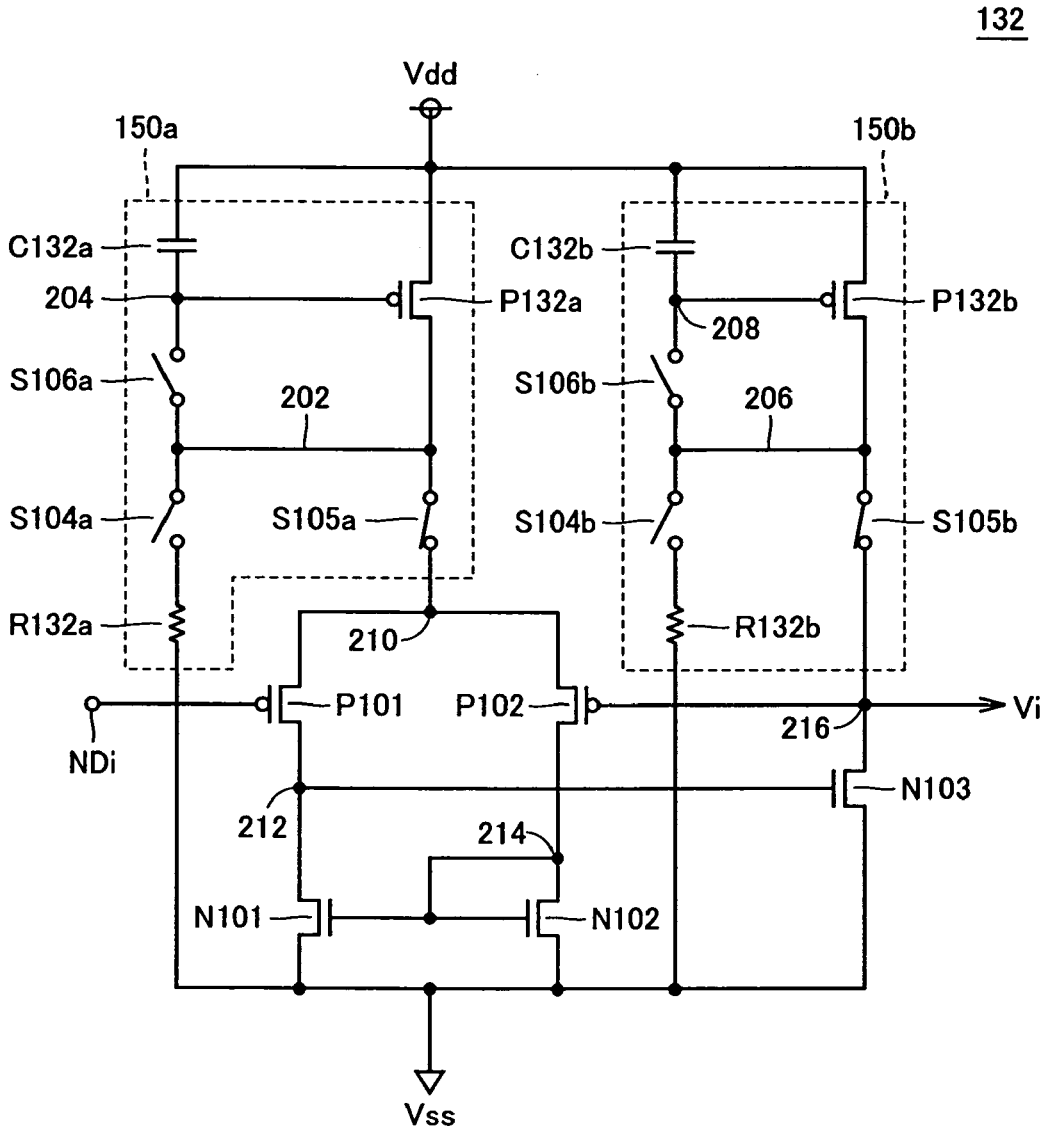
FIG. 15 is a circuit diagram showing a configuration of a first amplifier circuit shown in FIG. 14.

FIG. 15 is a circuit diagram showing a configuration of first amplifier circuit 132 shown in FIG. 14.

Referring to FIG. 15, first amplifier circuit 132 is formed of P-type TFT elements P101 and P102, N-type TFT elements N101, N102 and N103, constant current circuits 150*a* and 150*b*, a power supply node Vdd, a ground node Vss, nodes 210-215, and an output node 216. Output node 216 is connected to output node 140 shown in FIG. 14.

P-type TFT elements P101 and P102 as we as N-type TFT elements N101 and N102 form a differential circuit. N-type TFT element N103 is connected between output node 216 and ground node Vss, and has a gate connected to a node 212. When the voltage level of output node 216 is higher than that of node NDi, the voltage level of node 212 rises so that a current flowing through N-type TFT element N103 increases, and an amount of electric charges discharged from output node 216 to ground node Vss increases. Therefore, the voltage level of output node 216 lowers.

Constant current circuit 150*a* is formed of a P-type TFT element P132*a*, a capacitor C132*a*, switches S104*a*, S105*a* and S106*a*, a resistance element R132*a* and nodes 202 and 204. P-type TFT element P132*a* is a transistor passing a constant current, is connected between a power supply node Vdd and node 202, and has a gate connected to node 204. Capacitor C132*a* is a voltage holding capacitor holding a gate voltage of P-type TFT element P132*a*, and is connected between power supply node Vdd and node 204.

Switches S104*a*-S106*a* change their states in accordance with the voltage setting operation for setting the gate voltage of P-type TFT element P132*a* and the current driving operation. Switch S104*a* is connected between node 202 and resistance element R132*a*, and switch S105*a* is connected between node 210 connected to the differential circuit and node 202. Switch S106*a* is connected between nodes 202 and 204. Resistance element R132*a* is provided for supplying a predetermined current to node 202 in the voltage setting operation, and is connected between switch S104*a* and ground node Vss.

Constant current circuit 150*a* has a configuration similar to that of constant current circuit 1A in the second embodiment already described. Therefore, even if the transistor passing a constant current is formed of P-type TFT element P132*a*, constant current circuit 150*a* can supply a constant current to the differential amplifier without an influence by variations in threshold voltage of P-type TFT element P132*a* so that the differential circuit does not malfunction.

Constant current circuit 150*b* is formed of a P-type TFT element P132*b*, a capacitor C132*b*, switches S104*b*-S106*b*, a resistance element R132*b* and nodes 206 and 208. The configuration of constant current circuit 150*b* is the same as that of constant current circuit 150*a*, and therefore, description thereof is not repeated.

Constant current circuit 150*b* is provided for increasing a voltage level of output node 216 to a voltage level of node NDi. If the voltage level of output node 216 exceeds the voltage level of node NDi, N-type TFT element N103 becomes active, and the voltage level of output node 216 lowers. If the voltage level of output node 216 becomes lower than the voltage level of node 138 shown in FIG. 14, the P-type TFT element included in second amplifier circuit 134, which will be described later with reference to FIG. 16, becomes active to raise the voltage level of output node 216.

As described above, however, resistance element R136 sets the input voltage of second amplifier circuit 134 to the voltage level lower than that of node NDi for preventing simultaneous operation of first and second amplifier circuits 132 and 134. Therefore, the voltage level of output node 216 rises only to the voltage level of node 138. Therefore, constant current circuit 150*b* is provided for raising the voltage level of output node 216 to the voltage level of node NDi.

If a malfunction occurred in the constant current circuit provided for increasing the voltage level of output node 216 to the voltage level of node NDi, the voltage level of output node 216 would have an offset with respect to the voltage level of node NDi. Consequently, the drive voltage applied to the pixel would have an offset. Therefore, the operation stability of the constant current circuit is important, and liquid crystal display device 100 according to the fifth embodiment is provided with constant current circuit 150*b* already described for achieving the stable operation of the constant current circuit.

Figure 16:
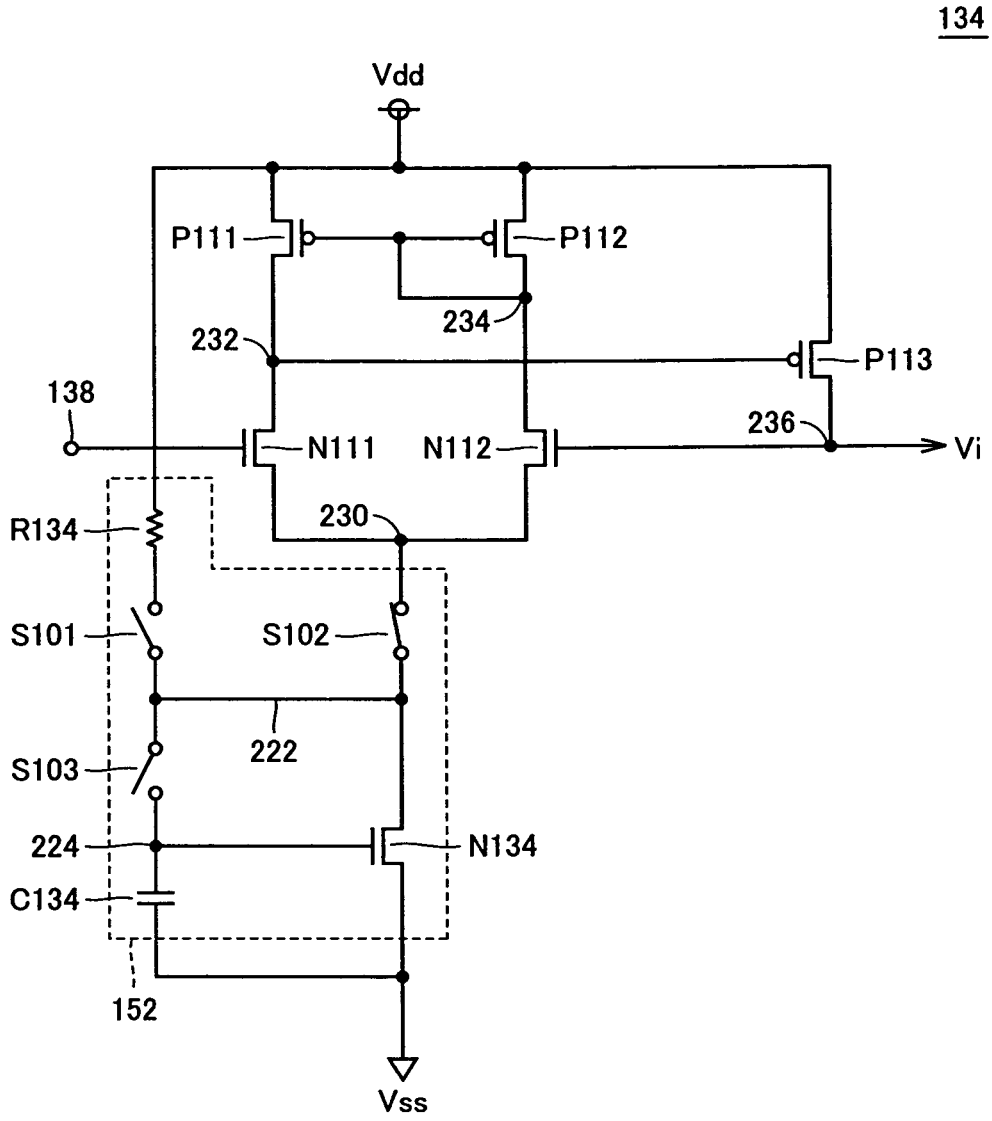
FIG. 16 is a circuit diagram showing a configuration of a second amplifier circuit shown in FIG. 14.

FIG. 16 is a circuit diagram showing a configuration of second amplifier circuit 134 shown in FIG. 14.

Referring to FIG. 16, second amplifier circuit 134 is formed of P-type TFT elements P111-P113, N-type TFT elements N111 and N112, a constant current circuit 152, power supply node Vdd, ground node Vss, nodes 230-235 and an output node 236. Output node 236 is connected to output node 140 shown in FIG. 14.

P-type TFT elements P111 and P112 as well as N-type TFT elements N111 and N112 form a differential circuit. P-type TFT element P113 is connected between power supply node Vdd and output node 236, and has a gate connected to node 232. When the voltage level of output node 236 is lower than that of node 138, the voltage level of node 232 lowers so that a current flowing through P-type TFT element P113 increases, and the amount of electric charges supplied from power supply node Vdd to output node 236 increases. Therefore, the voltage level of output node 236 rises.

Constant current circuit 152 is formed of an N-type TFT element N134, a capacitor C134, switches S101-S103, resistance element R134, and nodes 222 and 224. N-type TFT element N134 is a transistor passing a constant current, is connected between node 222 and ground node Vss, and has a gate connected to node 224. Capacitor C134 is a voltage holding capacitor holding a gate voltage of N-type TFT element N134, and is connected between node 224 and ground node Vss.

Switches S101-S103 change their states in accordance with the voltage setting operation for setting the gate voltage of N-type TFT element N134 and the current driving operation. Switch S101 is connected between resistance element R134 and node 222. Switch S102 is connected between node 230 connected to the differential circuit and node 222, and switch S103 is connected between nodes 222 and 224. Resistance element R134 is provided for supplying a predetermined current to node 222 in the voltage setting operation, and is connected between power supply node Vdd and switch S101.

Constant current circuit 152 has a configuration similar to that of constant current circuit 1 of the first embodiment already described. Therefore, even if the transistor passing a constant current is formed of N-type TFT element N134, the constant current can be supplied to the differential circuit without an influence by variations in threshold voltage of the transistor so that the differential circuit does not malfunction.

Constant current circuits 150*a* and 150*b* in first amplifier circuit 132 described above as well as constant current circuit 152 in second amplifier circuit 134 employ resistance elements R132*a*, R132*b* and R134, respectively. As already described in connection with the third embodiment, N-type TFT elements of the depression type may be used instead of resistance elements R132*a*, R132*b* and R134. As already described in connection with the third embodiment, such N-type TFT elements achieve further stabilize the operations of first and second amplifier circuits 132 and 134, and thus the operation of voltage generating circuit 114 including them.

In liquid crystal display device 100 described above, each pixel performs the gradation display with 64-level. However, the gradation display levels are not restricted to 64, and may be more or fewer that 64. Depending on the numbers of levels of gradation display, the number of bits of pixel data DATA as well as the numbers of resistance elements of voltage generating circuit 114 and the buffer circuits are determined. However, the whole configuration does not substantially differ from the configuration already described, and therefore, description of the configurations for gradation display other than the above is not repeated for the sake of simplicity.

According to liquid crystal display device 100 of the fifth embodiment, as described above, the constant current circuit formed of the TFTs can perform the stable operation in the configuration having the voltage generating circuit, which is integrally formed together with the image display portion on the same glass substrate. Therefore, it is possible to prevent malfunction of the voltage generating circuit due to variations in threshold voltage of the TFTs.

Sixth Embodiment

In a sixth embodiment, constant current circuits of the first and second embodiments are applied to EL display devices.

In the EL display device, a voltage applied to the pixel is changed, and thereby a current supplied to a light-emitting element of a current-driven type, i.e., an organic light-emitting diode provided for each pixel is changed so that display brightness of the organic light-emitting diode changes. The voltage at multiple levels corresponding to the display brightness at multiple levels in each pixel is generated by a voltage generating circuit, and peripheral circuits including this voltage generating circuit can have configurations similar to those of the liquid crystal display device.

An EL display device 100A according to the sixth embodiment has the same configurations as liquid crystal display device 100 of the fifth embodiment except for the configurations of pixels. Therefore, description of the configurations of EL display device 100A other than the pixels is not repeated.

Figure 17:
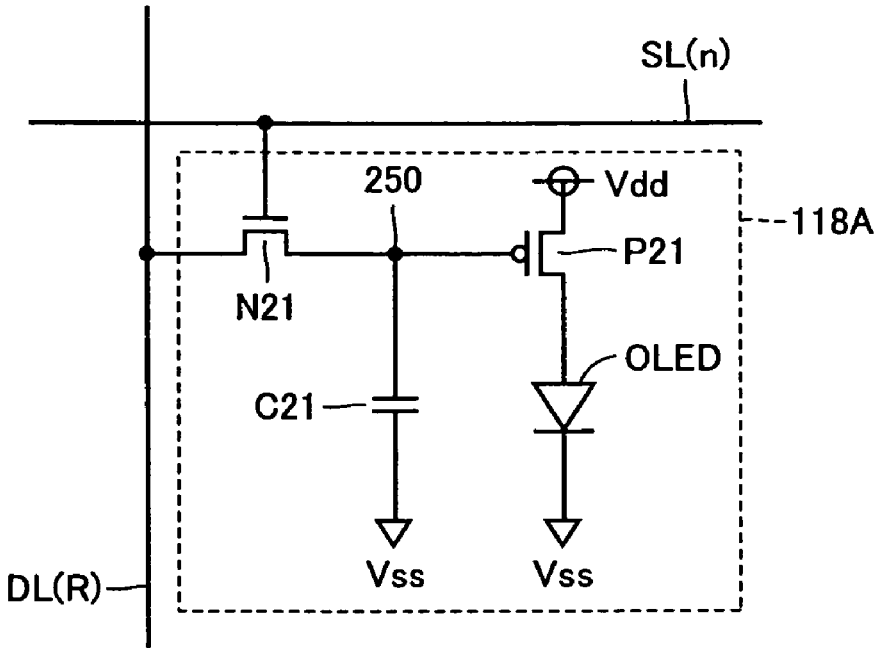
FIG. 17 is a circuit diagram showing a configuration of a pixel of an EL display device according to a sixth embodiment of the invention.

FIG. 17 is a circuit diagram showing a configuration of a pixel 118A of EL display device 100A according to the sixth embodiment. FIG. 17 shows pixel 118A connected to data line DL(R) and scanning line SL(n). Other pixels have the same configurations.

Referring to FIG. 17, pixel 118A includes an N-type TFT element N21, a P-type TFT element P21, an organic light-emitting diode OLED, a capacitor C21 and a node 250.

N-type TFT element N21 is connected between data line DL(R) and node 250, and has a gate connected to scanning line SL(n). P-type TFT element P21 is connected between power supply node Vdd and organic light-emitting diode OLED, and has a gate connected to node 250. Organic light-emitting diode OLED is connected between P-type TFT element P21 and common electrode Vss. Capacitor C21 is connected between node 250 and common electrode Vss.

Organic light-emitting diode OLED is a light-emitting element of a current-driven type, and changes its display brightness in accordance with a current supplied thereto. In FIG. 17, organic light-emitting diode OLED has a "cathode-common structure", in which a cathode is connected to common electrode Vss. Common electrode Vss is applied with a ground voltage or a predetermined negative voltage.

In pixel 118A, P-type TFT element P21 changes an amount of current supplied to organic light-emitting diode OLED in accordance with the level of the drive voltage applied from data line DL(R) via N-type TFT element N21. Therefore, organic light-emitting diode OLED changes its display brightness in accordance with the level of the drive voltage applied from data line DL(R).

Scanning line SL(n) is activated, and data line DL(R) applies the drive voltage to the gate of P-type TFT element P21 so that organic light-emitting diode OLED is supplied with the drive current. Thereafter, scanning line SL(n) is deactivated, and N-type TFT element N21 is turned off for starting the image display by next scanning line SL(n+1). Even during the off state of N-type TFT element N21, however, capacitor C21 holds the potential on node 250 so that organic light-emitting diode OLED can maintain the brightness corresponding to the pixel data.

In the sixth embodiment, resistance elements R132*a*, R132*b* and R134 employed in constant current circuits 150*a* and 150*b* of first amplifier circuit 132 and constant current circuit 152 of second amplifier circuit 134 may be replaced with N-type TFT elements of the depression type, as already described in connection with the fifth embodiment, or may be replaced with P-type TFT elements each having a gate connected to a source. Thereby, the operations of first and second amplifier circuits 132 and 134, and thus the operation of voltage generating circuit 114 including them can be further stable.

In EL display device 100A described above, each pixel performs the gradation display in 64 levels. However, the gradation display levels are not restricted to 64 levels, and may be more or fewer than 64 similarly to liquid crystal display device 100 of the fifth embodiment.

According to EL display device 100A of the sixth embodiment, as described above, the constant current circuit formed of the TFTs can perform the stable operation in the configuration having the voltage generating circuit, which is integrally formed together with the image display portion on the same glass substrate. Therefore, it is possible to prevent malfunction of the voltage generating circuit due to variations in threshold voltage of the TFTs.

Seventh Embodiment

A seventh embodiment employs a configuration corresponding to liquid crystal display device 100 of the fifth embodiment, and further employs the constant current circuit of the first embodiment in an analog amplifier, which provides a display voltage corresponding to the selected gradation voltage to data line DL.

Figure 18:
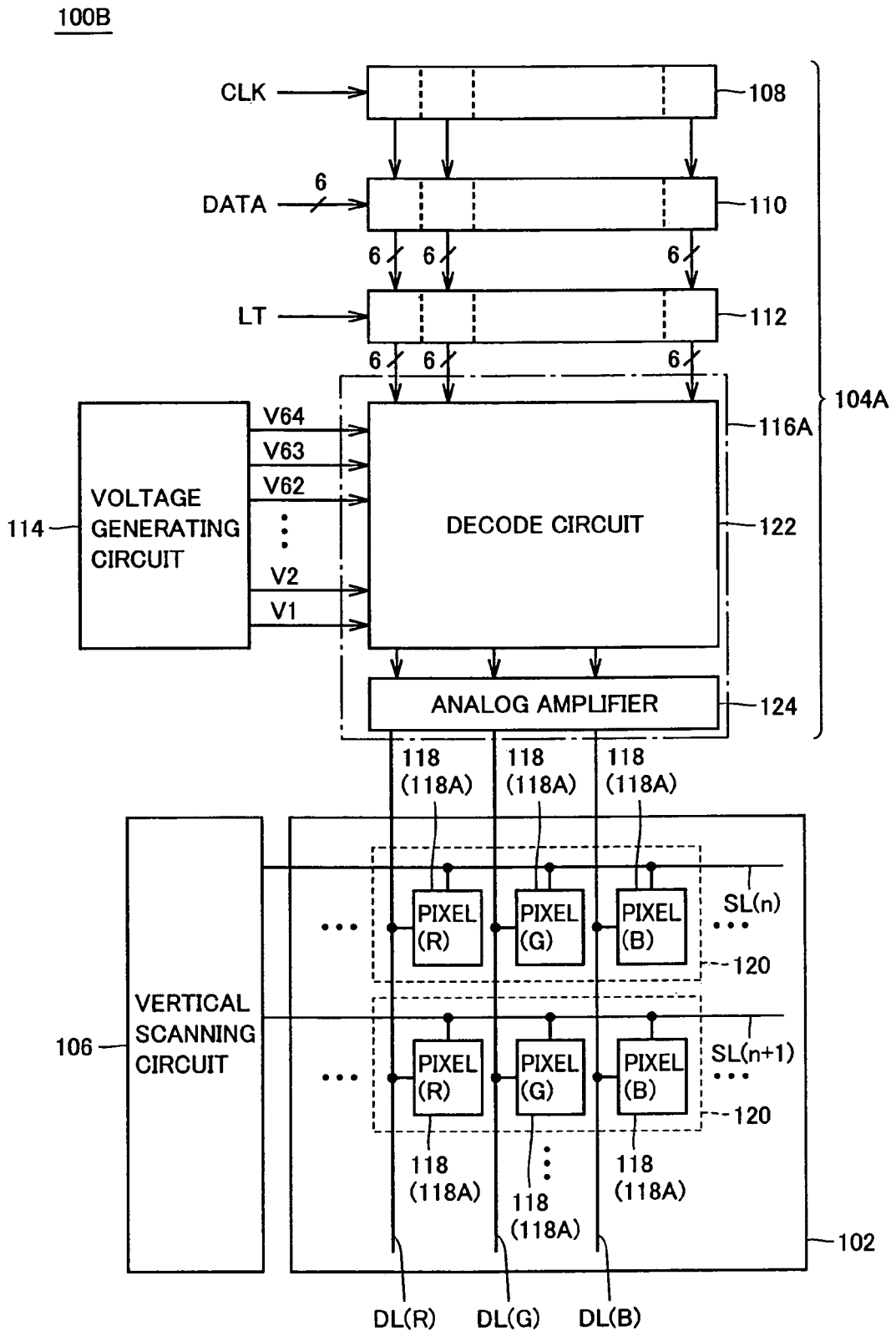
FIG. 18 is a schematic block diagram showing a whole configuration of a color liquid crystal display device according to a seventh embodiment of the invention.

FIG. 18 is a schematic block diagram showing a whole configuration of a color liquid crystal display device according to the seventh embodiment of the invention.

Referring to FIG. 18, a color liquid crystal display device 100B corresponds to color liquid crystal display device 100 of the fifth embodiment shown in FIG. 11 except for that a horizontal scanning circuit 104A is employed instead of horizontal scanning circuit 104. Horizontal scanning circuit 104A includes a data line driver 116A instead of data line driver 116 shown in FIG. 11, and data line driver 116A is formed of a decode circuit 122 and an analog amplifier 124.

Decode circuit 122 receives pixel data for one line provided from second data latch circuit 112 and gradation voltages V1-V64 provided from voltage generating circuit 114, and selects the gradation voltage corresponding to the pixel data for each pixel. Decode circuit 122 provides the gradation voltages thus selected for one line to analog amplifier 124 at the same time.

Analog amplifier 124 receives the gradation voltages for one line provided from decode circuit 122 with a high impedance, and provides the display voltages, which are the same as the received gradation voltages, to corresponding data lines DL with a low impedance.

Configurations of color liquid crystal display device 100B other than the above are the same as those of color liquid crystal display device 100 shown in FIG. 11, and therefore description thereof is not repeated.

Figure 19:
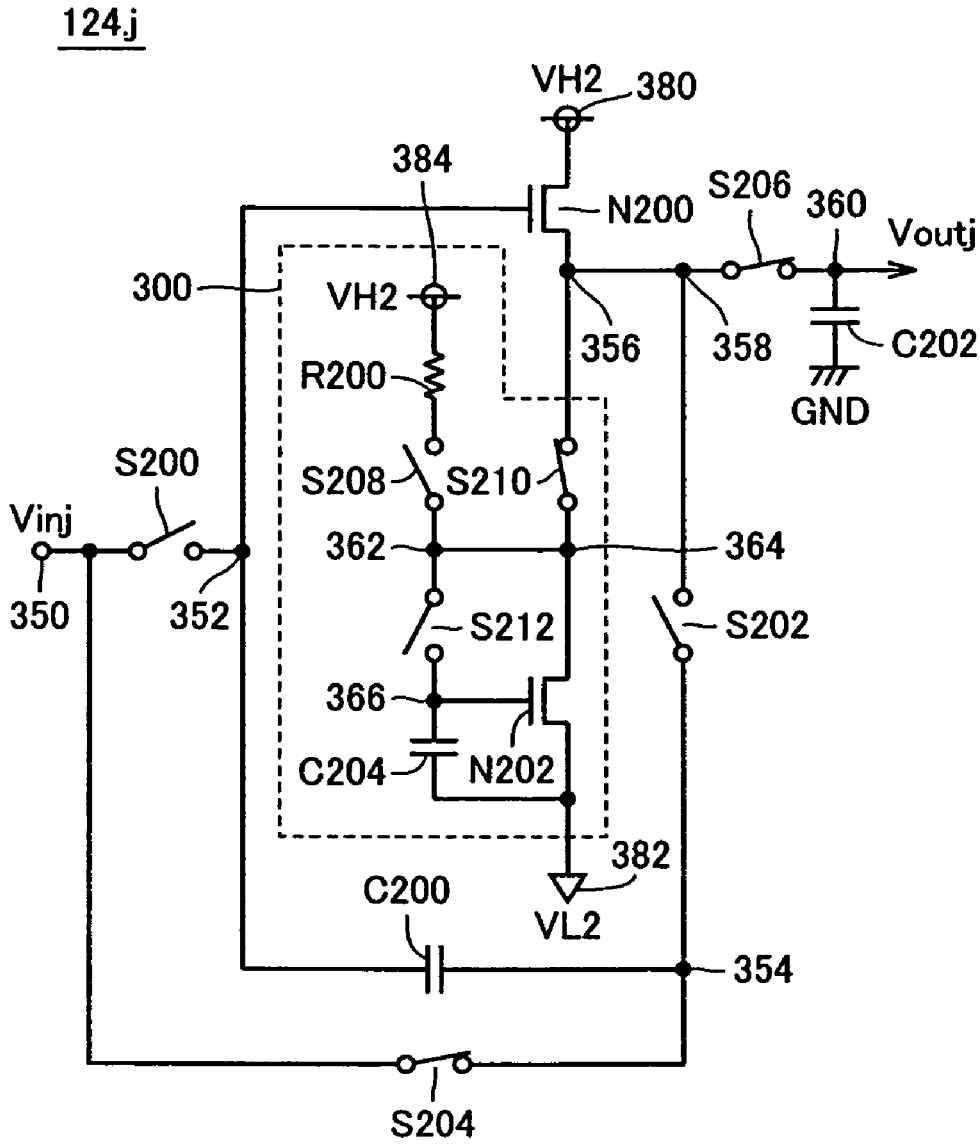
FIG. 19 is a circuit diagram showing a configuration of an analog amplifier shown in FIG. 18.

FIG. 19 is a circuit diagram showing a configuration of analog amplifier 124 shown in FIG. 18. The analog amplifier is provided for each data line DL, and can operate to receive the gradation voltage selected by decode circuit 122 and to provide the corresponding display voltage. FIG. 19 shows analog amplifier 124.*j* corresponding to data line DL in a jth (j is a natural position) position. The analog amplifiers corresponding to the other data lines DL have similar configurations.

Referring to FIG. 19, analog amplifier 124.*j* is formed of an N-type TFT element N200, a constant current circuit 300, switches S200-S206, capacitors C200 and C202, power supply nodes 380 and 382 applied with power supply voltages VH2 and VL2, respectively, and nodes 350-360. Node 360 is connected to corresponding data line DL (not shown in FIG. 19).

N-type TFT element N200 is connected between power supply node 380 and node 356, and has a gate connected to node 352. Power supply node 380 is applied with power supply voltage VH2, e.g., of 10 V. Constant current circuit 300 is connected to node 356 connected to a source of N-type TFT element N200. N-type TFT element N200 performs a source follower operation of receiving on its gate a voltage corresponding to an input voltage Vinj with a high impedance, and providing an output voltage Voutj with a low impedance to node 360.

Constant current circuit 300 is formed of an N-type TFT element N202, a capacitor C204, switches S208-S212, a resistance element R200, a power supply node 384 and nodes 362-366. N-type TFT element N202 is a transistor passing a constant current, is connected between node 364 and a power supply node 382, and has a gate connected to node 366. Capacitor C204 is a voltage holding capacitor, which holds a gate voltage of N-type TFT element N202, and is connected between node 366 and power supply node 382. Power supply nodes 384 and 382 are applied with power supply voltages VH2 and VL2, e.g., of 10 V and 0 V, respectively.

Switches S208-S212 change their states in accordance with the voltage setting operation for setting the gate voltage of N-type TFT element N202 and the current driving operation. Switch S208 is connected between resistance element R200 and node 362. Switch S210 is connected between nodes 356 and 364, and switch S212 is connected between nodes 362 and 366. Resistance element R200 is provided for supplying a predetermined current to N-type TFT element N202 in the voltage setting operation, and is connected between power supply node 380 and switch S208.

Constant current circuit 300 has a configuration similar to that of constant current circuit 1 of the first embodiment already described. Therefore, even if the transistor passing a constant current is formed of N-type TFT element N202, the constant current can flow through the driver transistor, i.e., N-type TFT element N200 without an influence by variations in threshold voltage of the transistor so that analog amplifier 124.*j* does not malfunction.

Switches S200, S202 and S204 as well as capacitor C200 form an offset compensating circuit compensating for an offset, which occurs between input voltage Vinj and output voltage Voutj due to a threshold voltage Vthn in N-type TFT element N200. Switch S200 is connected between input node 350 receiving input voltage Vinj and node 352. Switch S202 is connected between nodes 354 and 358. Switch S204 is connected between input node 350 and node 354.

This offset compensating circuit operates as follows. In a predetermined setting mode, switches S200, S202 and S204 are set to the on, on and off states, respectively. Thereby, input voltage Vinj is placed on the gate of N-type TFT element N200, and nodes 356 and 358 attain the potentials of (Vinj-Vthn). Therefore, capacitor C200 is charged to the level of potential difference Vthn between input potential Vinj and node 358.

When charging is completed, the setting mode ends, and switches S200, S202 and S204 are set to the off, off and on states, respectively. Thereby, the potential on node 354 attains Vinj so that node 352 and thus the gate of N-type TFT element N200 attain the potential of (Vinj+Vthn). Therefore, the potentials on nodes 356 and 358 attain Vinj. Thus, output voltage Voutj becomes equal to input voltage Vinj, and the offset voltage is canceled.

Since analog amplifier 124.*j* is provided with constant current circuit 300, the offset compensating circuit described above operates stably with high accuracy. Thus, constant current circuit 300 can pass a stable and constant current without malfunction. Therefore, capacitor C200 in the offset compensating circuit is stably and accurately charged with electric charges corresponding to threshold voltage Vthn causing the offset. Accordingly, N-type TFT element N200 has the stable and accurate gate voltage in the operation mode so that accurate output voltage Voutj without offset is output.

The capacitor C202 represents a capacitance of node 360 connected to data line DL, and switch S206 is provided for isolating capacitor C200 from node 360 so that the charging of capacitor C200 may end rapidly in the setting mode. If the capacitance of capacitor C202 is small, switching S206 may be eliminated.

According to the seventh embodiment, as described above, since analog amplifier 124 includes constant current circuit 300, it is possible to prevent malfunction of analog amplifier 124 due to variations in threshold voltage of the TFTs. Further, analog amplifier 124 includes an offset compensating circuit operating in constant current circuit 300. Therefore, no offset occurs in the gradation voltage received from decode circuit 122, and accurate display voltage can be output.

Accordingly, color liquid crystal display device 100B can operate stably with high accuracy even in the structure provided with peripheral circuits, which include analog amplifier 124 and are integrally formed together with the image display portion on the glass substrate.

Eighth Embodiment

A color liquid crystal display device according to an eighth embodiment has a configuration corresponding to that of color liquid crystal display device 100B of the seventh embodiment, but includes an analog amplifier 124A instead of analog amplifier 124.

Figure 20:
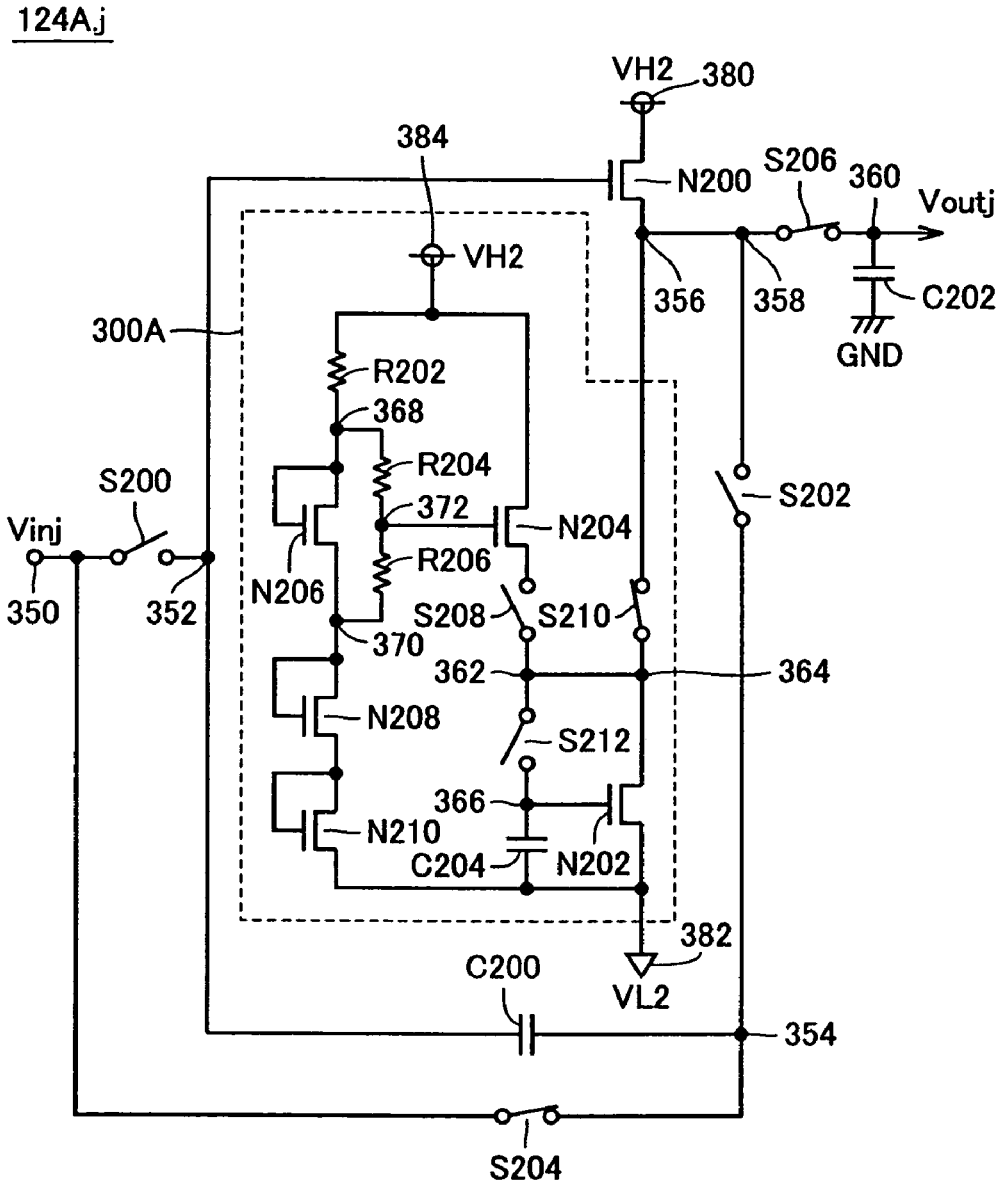
FIG. 20 is a circuit diagram showing a configuration of an analog amplifier according to an eighth embodiment.

FIG. 20 is a circuit diagram showing a configuration of analog amplifier 124A of the eighth embodiment. In this eighth embodiment, the analog amplifier is provided for each data line DL, and FIG. 20 shows analog amplifier 124A.j corresponding to data line DL in the jth position. The analog amplifiers corresponding to other data lines DL have similar circuit configurations.

Referring to FIG. 20, analog amplifier 124A.j has a configuration similar to that of analog amplifier 124.*j* of the seventh embodiment shown in FIG. 19, but includes a constant current circuit 300A instead of constant current circuit 300. Constant current circuit 300A is formed of N-type TFT elements N202-N210, capacitor C204, switches S208-S212, resistance elements R202-R206, power supply node 384 and nodes 362-372. Power supply node 384 is applied with power supply potential VH2.

N-type TFT element N204 is connected between power supply node 384 and switch S208, and has a gate connected to node 372. N-type TFT elements N206, N208 and N210 are connected in series between resistance element R202 and power supply node 382. Each of N-type TFT elements N206, N208 and N210 form an enhancement type of transistors each having a gate connected to its drain.

Resistance elements R204 and R206 are connected in series between nodes 368 and 370, and divide the voltage across the drain and source of N-type TFT element N206 in accordance with the resistance ratio between resistance elements R204 and R206. Node 372 connected to resistances R204 and R206 is connected to a gate of N-type TFT element N204.

Circuits other than the above are already described with reference to FIG. 19, and therefore, description thereof is not repeated.

Features of constant current circuit 300A are as follows. In the following description, it is assumed that no variation occurs in threshold voltage Vthn between N-type TFT elements N202-N210, and the variations in threshold voltage, which are used in the following description, represent variations with respect to the design values.

It is assumed that each of N-type TFT elements N202-N210 forming constant current circuit 300A has a threshold voltage Vthn, resistance elements R204 and R206 have resistance values R1 and R2, respectively, and power supply voltage VL2 is at the ground level of 0 V. In this case, the potential of node 372 and thus the gate potential of N-type TFT element N204 are expressed by the following formula:

$$Vg=2\times Vthn+Vthn\times R1/(R1+R2) \quad (3)$$

Resistance values R1 and R2 are sufficiently larger than the value of ON resistance of N-type TFT element N206. As expressed in formula (3), the gate voltage of N-type TFT element N204 depends on threshold voltage Vthn. In N-type TFT element N204, therefore, gate voltage Vg changes in accordance with variations in threshold voltage Vthn, and therefore, N-type TFT element N204 can have an improved margin for stable operations against variations in threshold voltage Vthn.

As expressed in formula (3), gate voltage Vg can be adjusted or controlled by adjusting resistance values R1 and R2. Therefore, the amount of current flowing through N-type TFT element N204, i.e., the amount of current flowing through constant current circuit 300A can be controlled by resistance values R1 and R2 of resistance elements R204 and R206.

According to the eighth embodiment, as described above, the operation of the constant current circuit as well as the operation of the analog amplifier including the same can be further stable so that the operation stability of the liquid crystal display device is further improved.

By appropriately controlling resistance values R1 and R2 of resistance elements R204 and R206, it is possible to control the amount of current flowing from constant current circuit 300A, and thereby to supply an appropriate amount of current from the constant current circuit so that the power consumption can be reduced.

Ninth Embodiment

Analog amplifiers 124 and 124A in the seventh and eighth embodiments are of the push type, in which the driver transistor, i.e., N-type TFT element N200 is connected between power supply node 380 and the output node. In contrast to this, a ninth embodiment provides an analog amplifier of a pull type.

A configuration of a color liquid crystal display device according to the ninth embodiment corresponds to that of color liquid crystal display device 100B of the seventh embodiment, but includes an analog amplifier 124B instead of analog amplifier 124.

Figure 21:
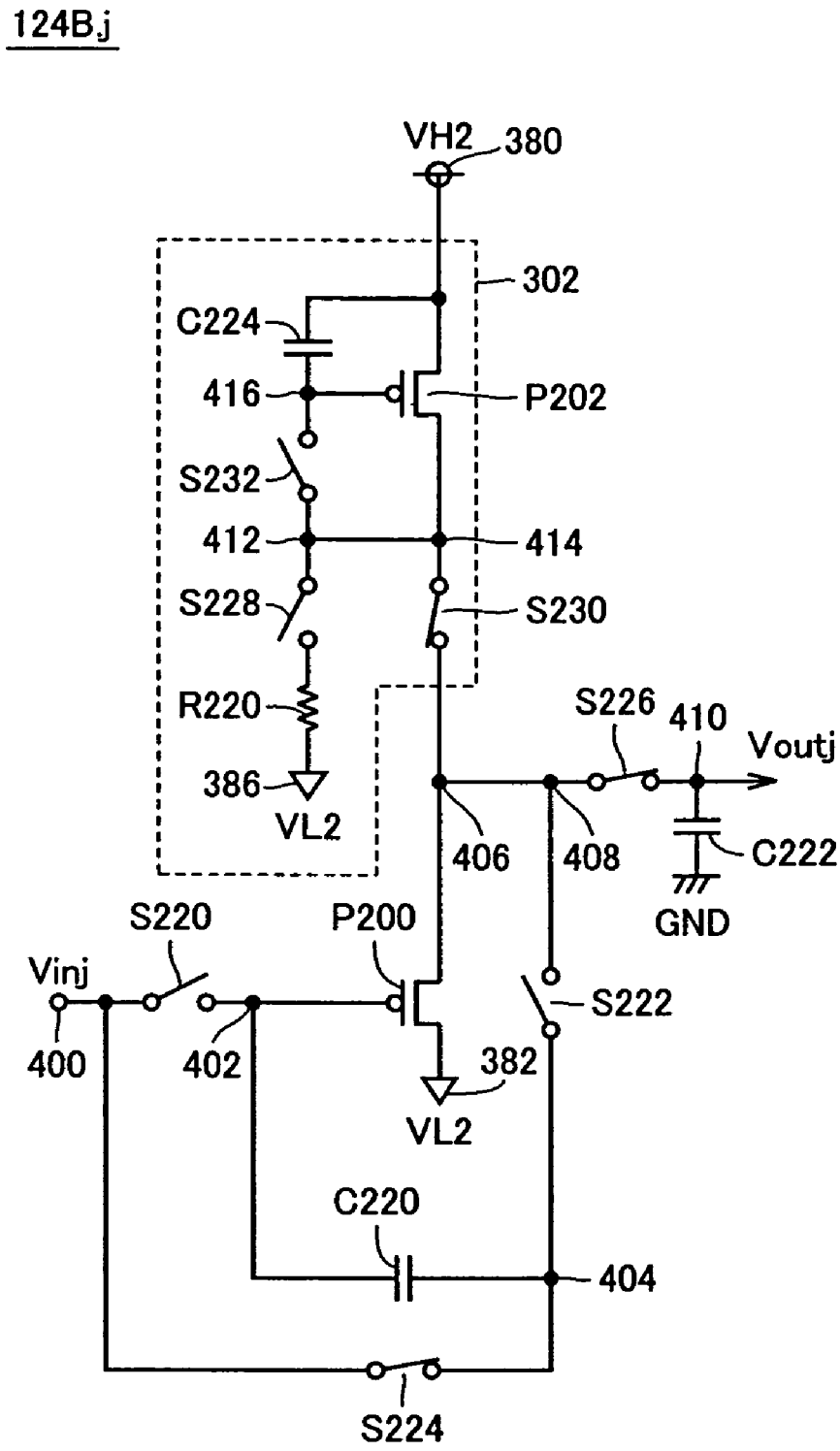
FIG. 21 is a circuit diagram showing a configuration of an analog amplifier according to a ninth embodiment.

FIG. 21 is a circuit diagram showing a configuration of analog amplifier 124B of the ninth embodiment. In the ninth embodiment, the analog amplifier is likewise provided for each data line DL. FIG. 21 shows an analog amplifier 124B.j corresponding to data line DL in a jth position. The analog amplifiers corresponding to other data lines have similar circuit configurations.

Referring to FIG. 21, analog amplifier 124B.j is formed of a P-type TFT element P200, a constant current circuit 302, switches S220-S226, capacitors C220 and C222, power supply nodes 380 and 382, and nodes 400-410. Node 410 is connected to corresponding data line DL (not shown in FIG. 21).

P-type TFT element P200 is connected between node 406 and power supply node 382, and has a gate connected to node 402. Power supply node 382 is applied with power supply voltage VL2, e.g., of a ground potential (0 V). Node 406 connected to a source of P-type TFT element P200 is connected to constant current circuit 302, and P-type TFT element P200 performs a source follower operation by receiving on its gate a voltage corresponding to input voltage Vinj with a high impedance, and providing output voltage Voutj to node 410 with a low impedance.

Constant current circuit 302 is formed of a P-type TFT element P202, a capacitor C224, switches S228-S232, a resistance element R220, a power supply node 386 and nodes 412-416. P-type TFT element P202 is a transistor passing a constant current, is connected between power supply node 380 and node 414, and has a gate connected to node 416. Capacitor C224 is a voltage holding capacitor holding a gate voltage of P-type TFT element P202, and is connected between power supply node 380 and node 416.

Switches S228-S232 change their states in accordance with the voltage setting operation for setting the gate voltage of P-type TFT element P202 and the current drive operation. Switch S228 is connected between node 412 and resistance element R220. Switch S230 is connected between nodes 414 and 406, and switch S232 is connected between nodes 416 and 412. Resistance element R220 is provided for passing a predetermined current through P-type TFT element P202 in the voltage setting operation, and is connected between switch S228 and power supply node 386.

Constant current circuit 302 has a configuration similar to that of constant current circuit 1A of the second embodiment already described. Therefore, even if the transistor passing a constant current is formed of P-type TFT element P202, the constant current can flow through the driver transistor, i.e., P-type TFT element P200 without an influence by variations in threshold voltage of the transistor so that analog amplifier 124B.j does not malfunction.

Switches S220, S222 and S224 as well as capacitor C220 form an offset compensating circuit compensating for an offset, which occurs between input voltage Vinj and output voltage Voutj due to a threshold voltage Vthp in P-type TFT element P200. Switch S220 is connected between input node 400 receiving input voltage Vinj and node 402. Switch S222 is connected between nodes 408 and 404. Switch S224 is connected between input node 400 and node 404.

This offset compensating circuit operates as follows. In a predetermined setting mode, switches S220, S222 and S224 are set to the on, on and off states, respectively. Thereby, input voltage Vinj is placed on the gate of P-type TFT element P200, and nodes 406 and 408 attain the potentials of (Vinj+|Vthp|). Therefore, capacitor C220 is charged to the level of potential difference |Vthp| between input potential Vinj and node 408.

When charging is completed, the setting mode ends, and switches S220, S222 and S224 are set to the off, off and on states, respectively. Thereby, the potential on node 404 attains Vinj so that node 402 and thus the gate of P-type TFT element P200 attain the potential of (Vinj−|Vthp|). Therefore, the potentials on nodes 406 and 408 attain Vinj. Thus, output voltage Voutj becomes equal to input voltage Vinj, and the offset voltage is canceled.

Since analog amplifier 124B.j is provided with constant current circuit 302, the offset compensating circuit described above operates stably with high accuracy. Thus, constant current circuit 302 can pass a stable and constant current without malfunction. Therefore, capacitor C220 in the offset compensating circuit is stably and accurately charged with electric charges corresponding to threshold voltage Vthp causing the offset. Accordingly, P-type TFT element P200 has the stable and accurate gate voltage in the operation mode so that accurate output voltage Voutj without offset is output.

The capacitor C222 represents a capacitance of node 410 connected to data line DL, and switch S226 is provided for isolating capacitor C220 from node 410 so that the charging of capacitor C220 may end rapidly in the setting mode. If the capacitance of capacitor C222 is small, switching S226 may be eliminated.

As described above, the liquid crystal display device of the ninth embodiment including analog amplifier 124B of the pull type can achieve the effects similar to those of the seventh embodiment.

Tenth Embodiment

A configuration of a color liquid crystal display device according to a tenth embodiment corresponds to that of color liquid crystal display device 100B of the seventh embodiment, but includes an analog amplifier 124C instead of analog amplifier 124.

Figure 22:
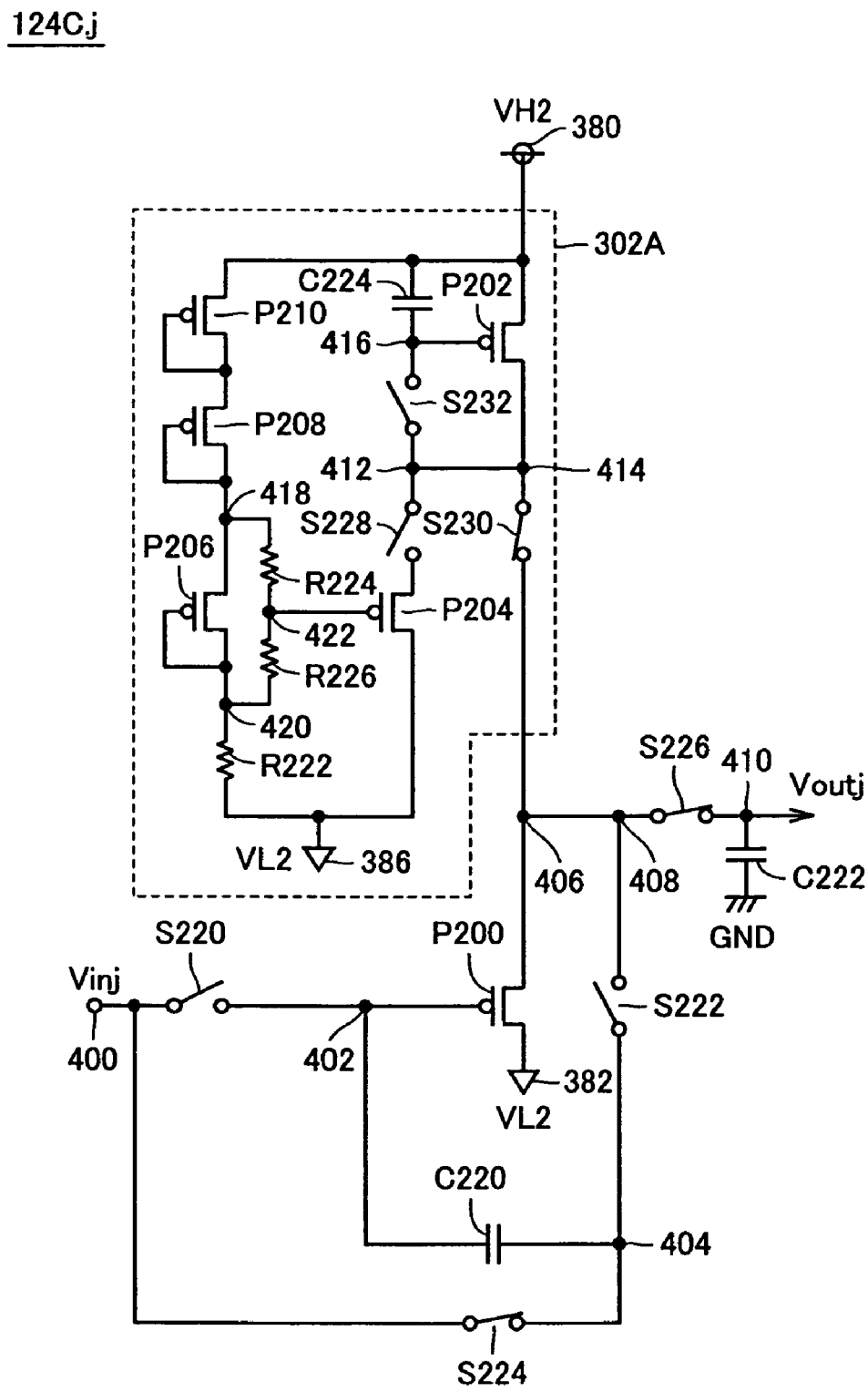
FIG. 22 is a circuit diagram showing a configuration of an analog amplifier according to a tenth embodiment.

FIG. 22 is a circuit diagram showing a configuration of analog amplifier 124C of the tenth embodiment. In the tenth embodiment, the analog amplifier is likewise provided for each data line DL. FIG. 22 shows an analog amplifier 124C.j corresponding to data line DL in a jth position. The analog amplifiers corresponding to other data lines have similar circuit configurations.

Referring to FIG. 22, analog amplifier 124C.j has a configuration similar to that of analog amplifier 124B.j of the ninth embodiment shown in FIG. 21, but includes a constant current circuit 302A instead of constant current circuit 302. Constant current circuit 302A is formed of P-type TFT elements P202-P210, capacitor C224, switches S228-S232, resistance elements R222-R226, power supply node 386 and nodes 412-422. Power supply node 386 is applied with power supply potential VL2.

P-type TFT element P204 is connected between switch S228 and power supply node 386, and has a gate connected to node 422. P-type TFT elements P206, P208 and P210 are connected in series between power supply node 380 and resistance element R222. Each of P-type TFT elements P206, P208 and P210 forms an enhancement type of transistors each having a gate connected to its drain.

Resistance elements R224 and R226 are connected in series between nodes 418 and 420, and divide the voltage across the drain and source of P-type TFT element P206 in accordance with the resistance ratio between resistance elements R224 and R226. Node 422 connected to resistances R224 and R226 is connected to a gate of P-type TFT element P204.

Circuits other than the above are already described with reference to FIG. 21, and therefore, description thereof is not repeated.

Features of constant current circuit 302A are as follows. In the following description, it is assumed that no variation occurs in threshold voltage Vthp between P-type TFT elements P202-P210, and the variations in threshold voltage, which are used in the following description, represent variations with respect to the design values.

Assuming that each of P-type TFT elements P202-P210 forming constant current circuit 302A has threshold voltage Vthp, and resistance elements R224 and R226 have resistance values R3 and R4, respectively. In this case, the potential of node 422 and thus the gate potential of P-type TFT element P204 are expressed by the following formula:

$$Vg=VH2-2\times|Vthp|-|Vthp|\times R3/(R3+R4) \quad (4)$$

Resistance values R3 and R4 are sufficiently larger than the value of ON resistance of P-type TFT element P206. As expressed in formula (4), the gate voltage of P-type TFT element P204 depends on threshold voltage Vthp. In P-type TFT element P204, therefore, gate voltage Vg changes in accordance with variations in threshold voltage Vthp, and therefore, P-type TFT element P204 can have an improved margin for stable operations against variations in threshold voltage Vthp.

As expressed in formula (4), gate voltage Vg can be adjusted or controlled by adjusting resistance values R3 and R4. Therefore, the amount of current flowing through P-type TFT element P204, i.e., the amount of current flowing through constant current circuit 302A can be controlled by resistance values R3 and R4 of resistance elements R224 and R226.

As described above, the liquid crystal display device of the tenth embodiment including analog amplifier 124C of the pull type can achieve the effects similar to those of the eighth embodiment.

Eleventh Embodiment

A configuration of a color liquid crystal display device according to an eleventh embodiment corresponds to that of color liquid crystal display device 100B of the seventh embodiment, but includes an analog amplifier 124D instead of analog amplifier 124.

Figure 23:
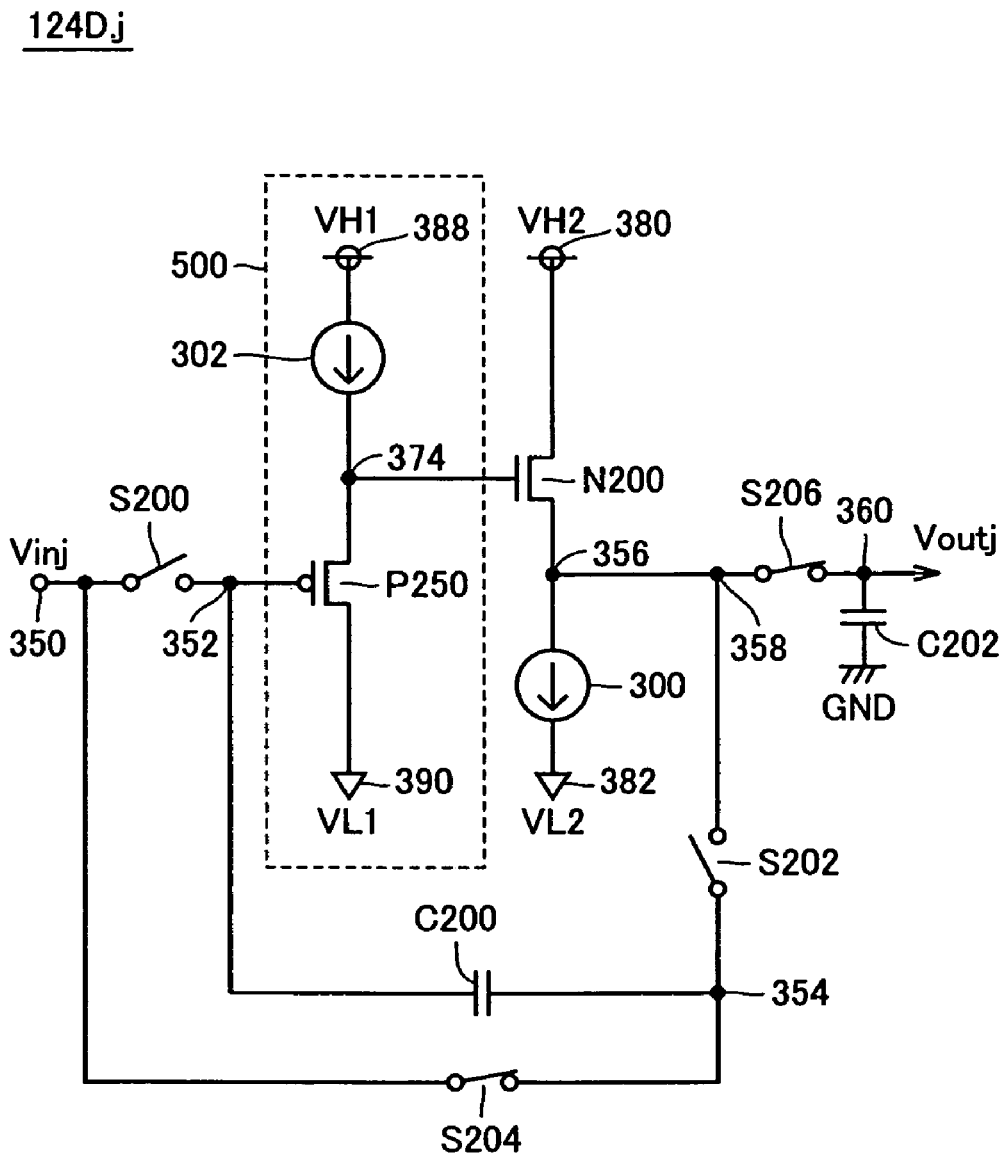
FIG. 23 is a circuit diagram showing a configuration of an analog amplifier according to an eleventh embodiment.

FIG. 23 is a circuit diagram showing a configuration of analog amplifier 124D of the eleventh embodiment. In the eleventh embodiment, the analog amplifier is likewise provided for each data line DL. FIG. 23 shows an analog amplifier 124D.j corresponding to data line DL in a jth position. The analog amplifiers corresponding to other data lines DL have similar circuit structures.

Referring to FIG. 23, analog amplifier 124D.j has a configuration corresponding to that of analog amplifier 124.*j* of the seventh embodiment shown in FIG. 19, and further includes a level shift circuit 500 arranged between a gate electrode of N-type TFT element N200 and node 352. Level shift circuit 500 includes a P-type TFT element P250, constant current circuit 302 and power supply nodes 388 and 390 applied with power supply voltages VH1 and VL1, respectively.

P-type TFT element P250 is connected between a node 374 and power supply node 390, and has a gate connected to node 352. Constant current circuit 302 is the same as that shown in FIG. 21, and is connected between power supply node 388 and node 374. Node 374 is connected to a gate of N-type TFT element N200. P-type TFT element P250 performs a source follower operation. Configurations other than the above are the same as those already described with reference to FIG. 19.

Analog amplifier 124D.j operates as follows. Assuming that P-type TFT element P250 has a gate potential Vg and a threshold voltage Vthp, the potential of node 374 is equal to (Vg+|Vthp|). Therefore, level shift circuit 500 outputs a potential prepared by shifting the potential supplied to level shift circuit 500 by |Vthp|.

In a predetermined setting mode, switches S200, S202 and S204 are set to the on, on and off states, respectively. Thereby, input voltage Vinj is placed on the gate of P-type TFT element P250, and node 374 has a potential of (Vinj+|Vthp|) so that nodes 356 and 358 have potentials of (Vinj+|Vthp|−Vthn). Therefore, capacitor C200 is charged to attain a potential equal to potential difference of (Vthn−|Vthp|) between input potential Vinj and the potential on node 358.

When the charging is completed, the setting mode ends, and switches S200, S202 and S204 are set to the off, off and on states, respectively. Thereby, node 354 attains the potential of Vinj so that the potential of node 352, i.e., the gate potential of P-type TFT element P250 becomes equal to (Vinj+Vthn−|Vthp|). Therefore, node 374 has a potential of (Vinj+Vthn), and nodes 356 and 358 have the potentials of Vinj. Thus, output voltage Voutj becomes equal to input voltage Vinj, and the offset voltage is canceled.

Level shift circuit 500 described above is provided for the following reasons. In analog amplifier 124.*j* of the seventh embodiment shown in FIG. 19, an unignorable error may occur depending on a magnitude of a parasitic capacitance of node 352 even if an offset compensating circuit is employed. However, the offset voltage itself due to the threshold voltage can be reduced if the threshold voltage of P-type TFT element P250 included in level shift circuit 500 is designed to attain a level close to the threshold voltage of N-type TFT element N200. Therefore, level shift circuit 500 is employed.

As described above, the eleventh embodiment can achieve the effects similar to those of the seventh embodiment.

Twelfth Embodiment

A configuration of a color liquid crystal display device according to a twelfth embodiment corresponds to that of color liquid crystal display device 100B of the seventh embodiment, but includes an analog amplifier 124E instead of analog amplifier 124.

Figure 24:
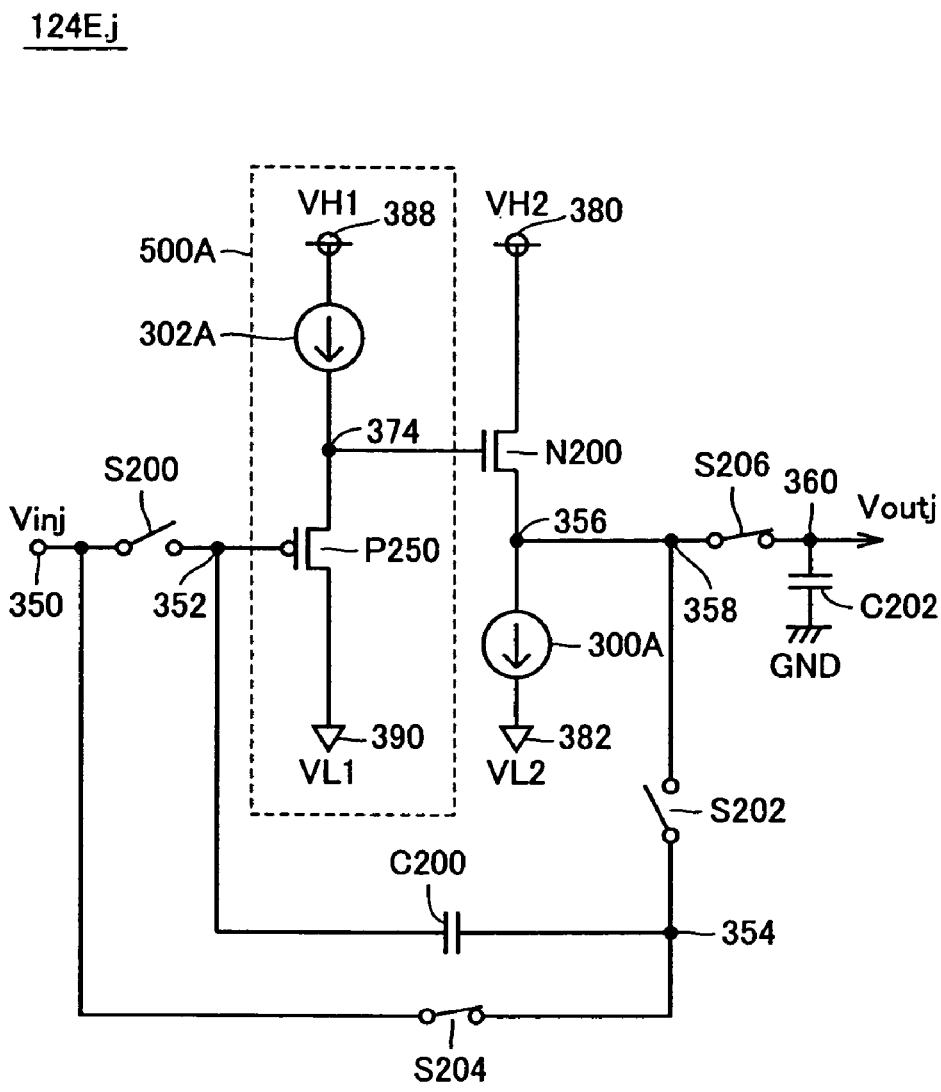
FIG. 24 is a circuit diagram showing a configuration of an analog amplifier according to a twelfth embodiment.

FIG. 24 is a circuit diagram showing a configuration of analog amplifier 124E of the twelfth embodiment. In the twelfth embodiment, the analog amplifier is likewise provided for each data line DL. FIG. 24 shows an analog amplifier 124E.j corresponding to data line DL in a jth position. The analog amplifiers corresponding to other data lines DL have similar circuit configurations.

Referring to FIG. 24, analog amplifier 124E.j has a configuration corresponding to that of analog amplifier 124D.j shown in FIG. 23. However, analog amplifier 124E.j includes constant current circuit 300A shown in FIG. 20 instead of constant current circuit 300, and also includes a level shift circuit 500A instead of level shift circuit 500. Level shift circuit 500A has a configuration corresponding to that of level shift circuit 500 except for that constant current circuit 302A shown in FIG. 22 is employed instead of constant current circuit 302.

Configurations of analog amplifier 124E.j other than the above are the same as those of analog amplifier 124D.j of the eleventh embodiment.

The twelfth embodiment can achieve effects similar to those of the eleventh embodiment and thus the seventh embodiment. Further, constant current circuits 300A and 302A stabilize the operation of the analog amplifier so that the operation stability of the liquid crystal display device is further improved.

Thirteenth Embodiment

A configuration of a color liquid crystal display device according to a thirteenth embodiment corresponds to that of color liquid crystal display device 100B of the seventh embodiment, but includes an analog amplifier 124F instead of analog amplifier 124.

Figure 25:
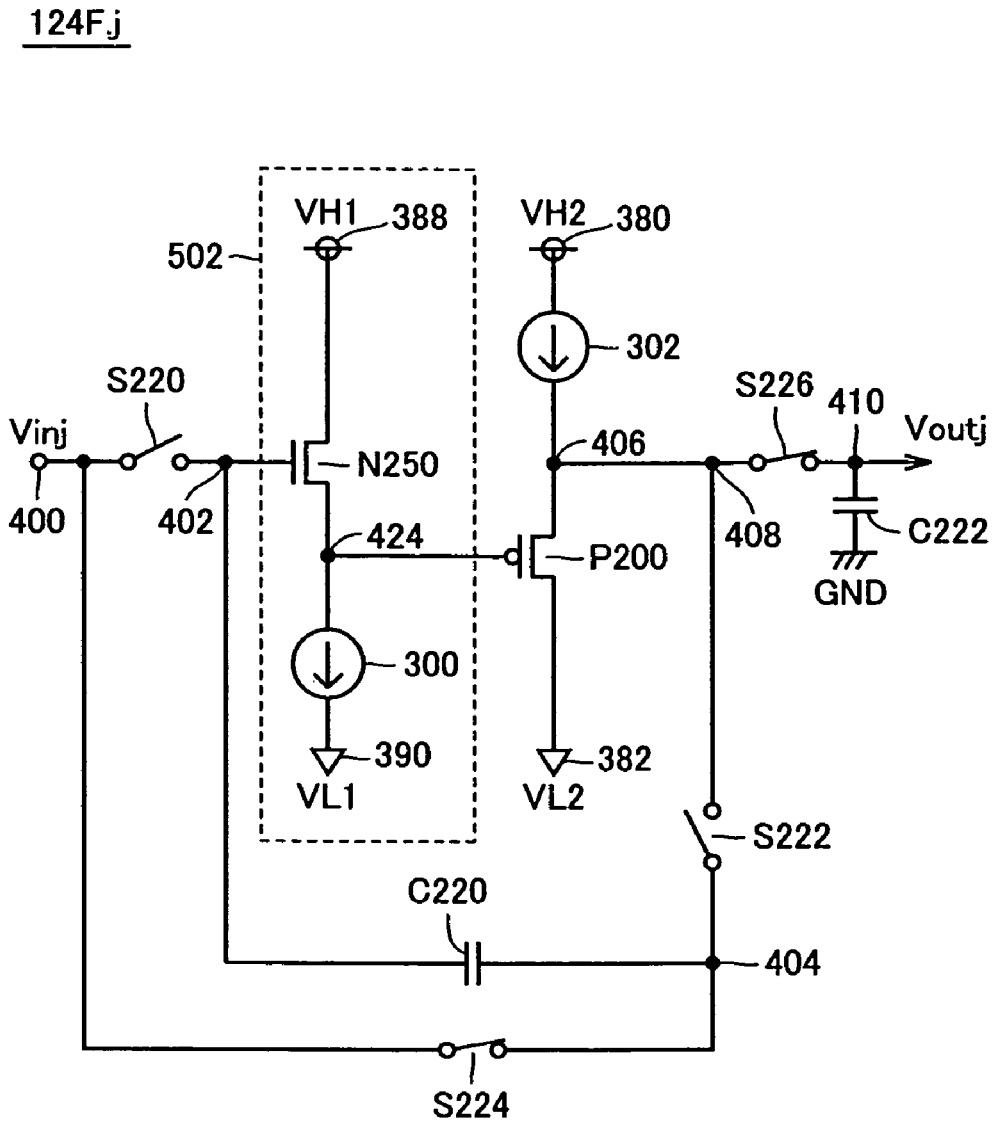
FIG. 25 is a circuit diagram showing a configuration of an analog amplifier according to a thirteenth embodiment.

FIG. 25 is a circuit diagram showing a configuration of analog amplifier 124F of the thirteenth embodiment. In the thirteenth embodiment, the analog amplifier is likewise provided for each data line DL. FIG. 25 shows an analog amplifier 124F.j corresponding to data line DL in a jth position. The analog amplifiers corresponding to other data lines DL have similar circuit configurations.

Referring to FIG. 25, analog amplifier 124F.j has a configuration corresponding to that of analog amplifier 124B.j of the ninth embodiment shown in FIG. 21, but further includes a level shift circuit 502 arranged between the gate electrode of P-type TFT element P200 and node 402. Level shift circuit 502 is formed of an N-type TFT element N250, constant current circuit 300 and power supply nodes 388 and 390 applied with power supply voltages VH1 and VL1, respectively.

N-type TFT element N250 is connected between power supply node 388 and a node 424, and has a gate connected to node 402. Constant current circuit 300 is the same as that shown in FIG. 19, and is connected between node 424 and power supply node 390. Node 424 is connected to a gate of P-type TFT element P200. N-type TFT element N250 performs a source follower operation. Configurations other than the above are the same as those already described with reference to FIG. 21.

Analog amplifier 124F.j operates as follows. Assuming that N-type TFT element N250 has a gate potential Vg and a threshold voltage Vthn, node 424 has a potential of (Vg−Vthn). Therefore, level shift circuit 502 outputs a potential prepared by shifting the potential supplied to level shift circuit 502 by −Vthn.

In a predetermined setting mode, when switches S220, S222 and S224 are set to the on, on and off states, respectively, input voltage Vinj is placed on the gate of N-type TFT element N250, and node 424 has a potential of (Vinj−Vthp) so that nodes 406 and 408 have potentials of (Vinj−Vthn+|Vthp|). Therefore, capacitor C220 is charged to attain a potential equal to potential difference (Vthn−|Vthp|) between input potential Vinj and the potential on node 408.

When the charging is completed, the setting mode ends, and switches S220, S222 and S224 are set to the off, off and on states, respectively. Thereby, node 404 attains the potential of Vinj so that the potential of node 402, i.e., the gate potential of N-type TFT element N250 becomes equal to (Vinj+Vthn−|Vthp|). Therefore, node 424 has a potential of (Vinj−|Vthp|), and nodes 406 and 408 have the potentials of Vinj. Thus, output voltage Voutj becomes equal to input voltage Vinj, and the offset voltage is canceled.

Level shift circuit 502 described above is provided for the same reasons as those for providing level shift circuit 500 in the eleventh embodiment, and description thereof is not repeated.

As described above, the thirteenth embodiment can achieve the effects similar to those of the ninth embodiment.

Fourteenth Embodiment

A configuration of a color liquid crystal display device according to a fourteenth embodiment corresponds to that of color liquid crystal display device 100B of the seventh embodiment, but includes an analog amplifier 124G instead of analog amplifier 124.

Figure 26:
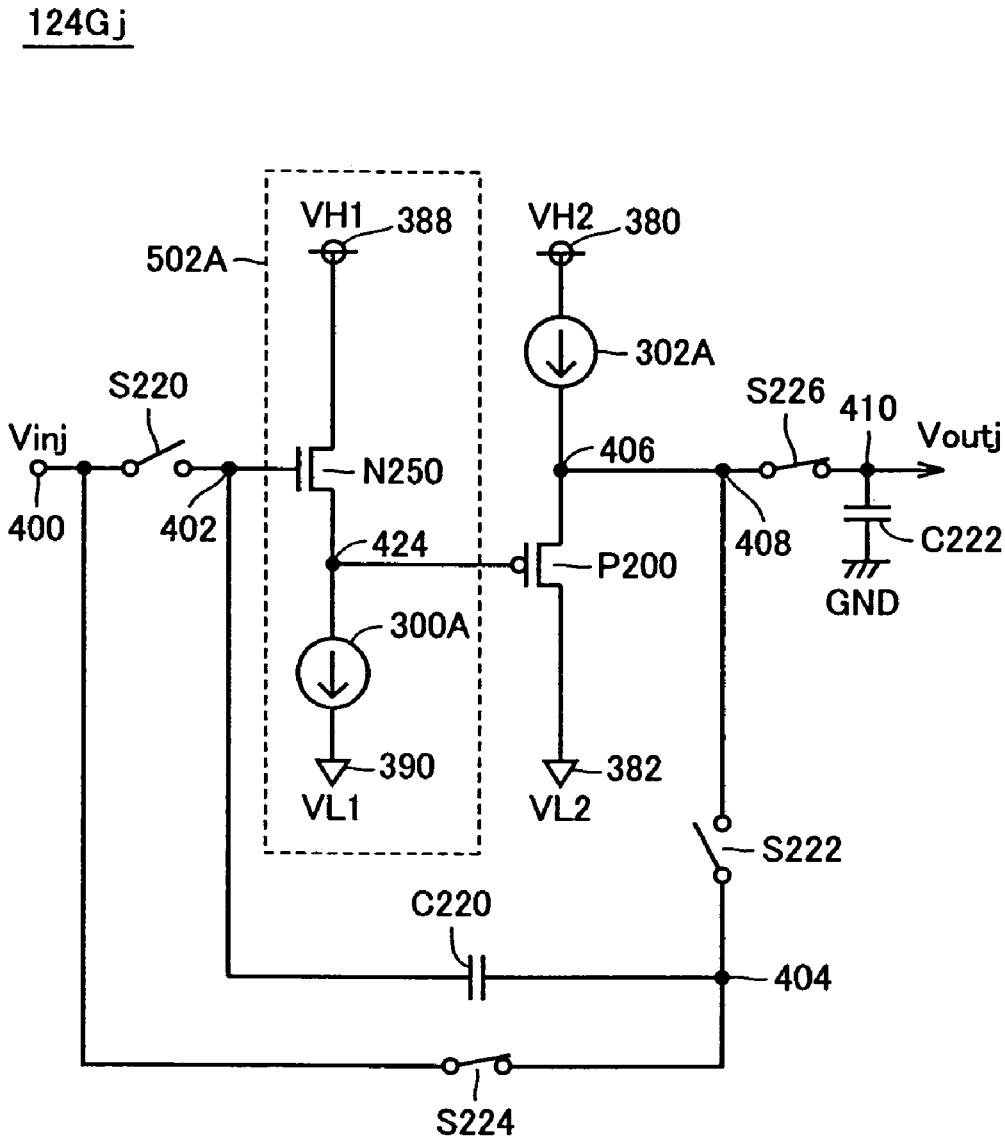
FIG. 26 is a circuit diagram showing a configuration of an analog amplifier according to a fourteenth embodiment.

FIG. 26 is a circuit diagram showing a configuration of analog amplifier 124G of the fourteenth embodiment. In the fourteenth embodiment, the analog amplifier is likewise provided for each data line DL. FIG. 26 shows an analog amplifier 124G.j corresponding to data line DL in a jth position. The analog amplifiers corresponding to other data lines DL have similar circuit configurations.

Referring to FIG. 26, analog amplifier 124G.j has a configuration corresponding to that of analog amplifier 124F.j shown in FIG. 25. However, analog amplifier 124G.j includes constant current circuit 302A shown in FIG. 22 instead of constant current circuit 302, and also includes a level shift circuit 502A instead of level shift circuit 502. Level shift circuit 502A has a configuration corresponding to that of level shift circuit 502 except for that constant current circuit 300A shown in FIG. 20 is employed instead of constant current circuit 300.

Configurations of analog amplifier 124G.j other than the above are the same as those of analog amplifier 124F.j of the thirteenth embodiment.

The fourteenth embodiment can achieve effects similar to those of the thirteenth embodiment and thus the ninth embodiment. Further, constant current circuits 302A and 300A stabilize the operation of the analog amplifier so that the operation stability of the liquid crystal display device is further improved.

The seventh to fourteenth embodiments have been described in connection with the cases, in which the constant current circuits of the first and second embodiments are applied to the analog amplifiers in the liquid crystal display devices. However, the analog amplifiers described in connection with the seventh to fourteenth embodiments may be applied to the EL display device already described in connection with the sixth embodiment, similarly to the application of the fifth embodiment to the sixth embodiment.

Although the present invention has been described and illustrated in detail, it is clearly understood that the same is by way of illustration and example only and is not to be taken by way of limitation, the spirit and scope of the present invention being limited only by the terms of the appended claims.

INDUSTRIAL APPLICABILITY

The constant current circuit according to the invention includes the voltage holding circuit holding the voltage, which is set based on the threshold voltage of the drive transistor passing the current, and the drive transistor receives the voltage held by the voltage holding circuit, and thereby passes the current. Therefore, even if manufacturing variations are present in threshold voltage of the drive transistor, the influence by such variations is removed, and the constant current circuit can operate stably.

Owing to the stable operation of the constant current circuit, the drive circuit having the constant current circuit as well as the image display device can operate stably.

The invention claimed is:

1. A drive circuit providing an output voltage in accordance with an input voltage comprising:

a first transistor connected between a first power supply node and an output node;

a constant current circuit connected between said output node and a second power supply node; and an offset compensating circuit compensating for an offset voltage occurring depending on a threshold voltage of said first transistor, wherein said offset compensating circuit holds said offset voltage, and provides a first voltage produced by shifting said input voltage by said held offset voltage to a gate electrode of said first transistor;

said constant current circuit includes;

a second transistor connected between said output node and said second power supply node, and a first voltage holding circuit holding a second voltage determined depending on a threshold voltage of said second transistor and provided for turning on said second transistor;

said second transistor receives on its gate electrode said second voltage, and passes a constant current through said first transistor connected to said output node; and said first transistor receives on its gate electrode said first voltage provided from said offset compensating circuit, and provides an output voltage at the same potential as said input voltage to said output node.

2. The drive circuit according to claim 1, wherein said offset compensating circuit includes:

a second voltage holding circuit charged in a setting mode, and holding said offset voltage in an operation mode, and a first switch circuit operating in said setting mode to connect to an input node a first node to which one end of said second voltage holding circuit and the gate electrode of said first transistor are connected, and to connect the other end of said second voltage holding circuit to said output node, and operating in said operation mode to isolate said first node and the other end of said second voltage holding circuit from said input node and said output node, respectively, and to connect said other end to said input node.

3. The drive circuit according to claim 1, wherein said constant current circuit further includes:

a current supply circuit supplying a current for setting said second voltage, and a switch circuit isolating said second transistor from said output node, and connecting said first voltage holding circuit and said second transistor to said current supply circuit when said second voltage is set; and said current supply circuit includes:

a voltage generating portion generating a gate voltage determined depending on a threshold voltage of a transistor forming said current supply circuit, and a third transistor connected between a third power supply node and said second switch circuit, and receiving on its gate electrode said gate voltage generated by said voltage generating portion.

4. The drive circuit according to claim 3, wherein said voltage generating portion includes:

a plurality of enhancement transistors connected in series between said third power supply node and said second power supply node, and a voltage dividing circuit connected in parallel to the enhancement transistor connected to said third power supply node, and having first and second resistances connected in series; and the gate electrode of said third transistor is connected to a node connecting said first resistance to said second resistance.

5. A drive circuit providing an output voltage in accordance with an input voltage, comprising:

a first transistor of a first conductivity type connected between a first power supply node and an output node;

a first constant current circuit connected between said output node and a second power supply node;

a level shift circuit receiving a first voltage, and providing a second voltage produced by shifting the received first voltage by a predetermined magnitude; and an offset compensating circuit compensating for an offset voltage occurring depending on a threshold voltage of said first transistor of the first conductivity type, wherein said level shift circuit includes:

a second constant current circuit connected between a third power supply node and a gate electrode of said first transistor of the first conductivity type, and a first transistor of a second conductivity type connected between the gate electrode of said first transistor of the first conductivity type and a fourth power supply node, wherein said offset compensating circuit holds a voltage difference between the threshold voltage of said first transistor of the first conductivity type and a threshold voltage of said first transistor of the second conductivity type, and provides, as said first voltage, a voltage produced by shifting said input voltage by said held voltage difference to a gate electrode of said first transistor of the second conductivity type;

said first constant current circuit includes:

a second transistor of the first conductivity type connected between said output node and said second power supply node, and a first voltage holding circuit holding a third voltage determined depending on a threshold voltage of said second transistor of the first conductivity type and provided for turning on said second transistor of the first conductivity type;

said second transistor of the first conductivity type receives on its gate electrode said third voltage, and passes a constant current through said first transistor of the first conductivity type connected to said output node;

said second constant current circuit includes:

a second transistor of the second conductivity type connected between said third power supply node and the gate electrode of said first transistor of the first conductivity type, and a second voltage holding circuit holding a fourth voltage determined depending on a threshold voltage of said second transistor of the second conductivity type and provided for turning on said second transistor of the second conductivity type;

said second transistor of the second conductivity type receives on its gate electrode said fourth voltage, and passes a constant current through said first transistor of the second conductivity type connected to the gate electrode of said first transistor of the first conductivity type;

said first transistor of the second conductivity type receives on its gate electrode said first voltage provided from said offset compensating circuit, and provides said second voltage produced by shifting said first voltage by the threshold voltage of said first transistor of the second conductivity type to the gate electrode of said first transistor of the first conductivity type; and said first transistor of the first conductivity type receives on its gate electrode said second voltage provided from said level shift circuit and provides an output voltage at the same potential as said input voltage to said output node.

6. The drive circuit according to claim 5, wherein said offset compensating circuit includes:

a third voltage holding circuit charged in a setting mode, and holding said voltage difference in an operation mode, and a first switch circuit operating in said setting mode to connect a first node, to which one end of said third voltage holding circuit and the gate electrode of said first transistor of the second conductivity type are connected, to an input node, and to connect the other end of said third voltage holding circuit to said output node, and operating in said operation mode to isolate said first node and the other end of said third voltage holding circuit from said input node and said output node, respectively, and to connect said other end to said input node.

7. The drive circuit according to claim 5, wherein said first constant current circuit further includes:

a first current supply circuit supplying a current for setting said third voltage, and a second switch circuit isolating said second transistor of the first conductivity type from said output node, and connecting said first voltage holding circuit and said second transistor of the first conductivity type to said first current supply circuit when said third voltage is set;

said first current supply circuit includes:

a first voltage generating portion generating a gate voltage determined depending on a threshold voltage of a transistor of the first conductivity type forming said first current supply circuit, and a third transistor of the first conductivity type connected between a fifth power supply node and said second switch circuit, and receiving on its gate electrode said gate voltage generated by said first voltage generating portion;

said second constant current circuit further includes:

a second current supply circuit supplying a current for setting said fourth voltage, and a third switch circuit isolating said second transistor of the second conductivity type from the gate electrode of said first transistor of the first conductivity type, and connecting said second voltage holding circuit and said second transistor of the second conductivity type to said second current supply circuit when said fourth voltage is set; and said second current supply circuit includes:

a second voltage generating portion generating a gate voltage determined depending on a threshold voltage of a transistor of the second conductivity type forming said second current supply circuit, and a third transistor of the second conductivity type connected between a sixth power supply node and said third switch circuit, and receiving on its gate electrode said gate voltage generated by said second voltage generating portion.

8. An image display device comprising:

a plurality of image display elements arranged in rows and columns;

a plurality of scanning lines arranged corresponding to the rows of said plurality of image display elements, respectively, and selected successively with predetermined cycles;

a plurality of data lines arranged corresponding to the columns of said plurality of image display elements, respectively;

a voltage generating circuit generating at least one voltage corresponding to display brightness of each of said plurality of image display elements;

a decode circuit selecting, for each of the image display elements in the row to be scanned, a voltage designated by the pixel data corresponding to each of said image display elements in the row to be scanned from said at least one voltage; and the drive circuit according to claim 1 or 5, receiving the voltage selected by said decode circuit from said decode circuit, and activating said plurality of data lines with the corresponding voltages.

9. The image display device according to claim 8, wherein each of said plurality of image display elements, said voltage generating circuit, said decode circuit and said drive circuit includes transistors, said transistors are thin film transistors.

10. The image display device according to claim 8, wherein said plurality of image display elements, said voltage generating circuit, said decode circuit and said drive circuit are integrally formed on either a glass substrate or a resin substrate.

* * * * *